US011600927B2

(12) United States Patent
Che et al.

(10) Patent No.: US 11,600,927 B2
(45) Date of Patent: Mar. 7, 2023

(54) COUPLING-OFFSET PATH BRANCH AND HIGH-ISOLATION MILLIMETER-WAVE PHASED ARRAY ANTENNA BASED ON THE SAME

(71) Applicant: SOUTH CHINA UNIVERSITY OF TECHNOLOGY, Guangdong (CN)

(72) Inventors: Wenquan Che, Guangdong (CN); Wanchen Yang, Guangdong (CN); Lizheng Gu, Guangdong (CN); Quan Xue, Guangdong (CN); Shaowei Liao, Guangdong (CN)

(73) Assignee: SOUTH CHINA UNIVERSITY OF TECHNOLOGY, Guangzhou (CN)

( * ) Notice: Subject to any disclaimer, the term of this patent is extended or adjusted under 35 U.S.C. 154(b) by 22 days.

(21) Appl. No.: 17/243,607

(22) Filed: Apr. 29, 2021

(65) Prior Publication Data

US 2022/0209411 A1 Jun. 30, 2022

(30) Foreign Application Priority Data

Dec. 30, 2020 (CN) ..... 202011629811.X

(51) Int. Cl.
*H01Q 1/48* (2006.01)
*H01Q 9/04* (2006.01)
*H01Q 3/30* (2006.01)

(52) U.S. Cl.
CPC ..... *H01Q 9/045* (2013.01); *H01Q 1/48* (2013.01); *H01Q 3/30* (2013.01); *H01Q 9/0414* (2013.01)

(58) Field of Classification Search
CPC ..... H01Q 9/045; H01Q 1/48; H01Q 3/30; H01Q 9/0414; H01Q 1/52
See application file for complete search history.

(56) References Cited

FOREIGN PATENT DOCUMENTS

WO WO-2020124315 A1 * 6/2020

OTHER PUBLICATIONS

Ke-Li Wu et al., "Array-Antenna Decoupling Surface," IEEE Transactions on Antennas and Propagation, vol. 65, No. 12, Dec. 2017, pp. 1-12.
Ningning Yan et al., "A Novel Substrate-Integrated Suspended Line Stacked-Patch Antenna Array for WLAN," IEEE Transactions on Antennas and Propagation, vol. 66, No. 7, Jul. 2018, pp. 1-9.

* cited by examiner

*Primary Examiner* — Dieu Hien T Duong
(74) *Attorney, Agent, or Firm* — JCIPRNET

(57) ABSTRACT

A coupling-offset path branch and a high-isolation millimeter-wave phased array antenna based on the same. The high-isolation millimeter-wave phased array antenna includes a plurality of radiating stacked microstrip patch elements, a shielding metal wall, several coupling-offset path branches, a metal ground plane, a feeding network layer, several ports, wherein the first port is excited, energy of the feeding network layer is coupled to a corresponding radiating stacked microstrip patch element through an I-shaped slot, and the energy is transmitted to the second port adjacent to the first port through an inherent coupling path portion; the coupling-offset path branch is introduced to offset the inherent coupling, thus achieving a high-isolation performance between the first port and the second port. By adopting the simple decoupling branch, the invention can achieve a high-isolation effect in a wide band, improve an active standing-wave ratio and a scanning capability of the array antenna.

9 Claims, 28 Drawing Sheets

COUPLING-OFFSET PATH BRANCH AND HIGH-ISOLATION MILLIMETER-WAVE PHASED ARRAY ANTENNA BASED ON THE SAME

CROSS-REFERENCE TO RELATED APPLICATION

This application claims the priority benefit of China application serial no. 202011629811.X, filed on Dec. 30, 2020. The entirety of the above-mentioned patent application is hereby incorporated by reference herein and made a part of this specification.

BACKGROUND

Technical Field

The present invention relates to the field of millimeter-wave phased array antennas, and more particularly, relates to a coupling-offset path branch and a high-isolation millimeter-wave phased array antenna based on the same.

Description of Related Art

With the development of the fifth-generation wireless communication technology, a millimeter-wave array antenna is a hot research topic. The millimeter-wave array antenna has the advantages such as a high bandwidth, a high speed, low delay, and a small size and so on, and is widely used in a base station antenna, indoor communication, fixed-point communication, and other occasions. However, there are problems of a serious surface wave and excessively high coupling in a millimeter-wave antenna array, which seriously deteriorate a radiation efficiency and a scanning angle of the array antenna. In order to improve the coupling between the array antennas, a traditional high-isolation method is generally applied to a binary array, which is difficult to be extended to large array design. In recent years, an array antenna adopting a decoupling surface is capable of well implementing a high-isolation performance (K. L. Wu, C. Wei, X. Mei, and Z. Y. Zhang, "Array-Antenna Decoupling Surface," *IEEE Trans. Antennas Propag.*, vol. 65, no. 12, pp. 6728-6738, December 2017.). However, according to this decoupling structure, the decoupling surfaces need to be placed at some specific positions over the antenna array, and this height is jointly determined by a reflection phase of the decoupling surface and an inherent coupling phase. However, there may be many problems of an extra profile, complex design, and the like brought by adopting this decoupling surface, thus bringing great challenges to the overall design of the antenna array, and the decoupling surface is not suitable for antenna design in a compact environment. A radiating stacked microstrip patch element (N. Yan, K. Ma, and H. Zhang, "A Novel Substrate-Integrated Suspended Line Stacked-Patch Antenna Array for WLAN," *IEEE Trans. Antennas Propag.*, vol. 66, no. 7, pp. 3491-3499, 2018.) serving as a broadband low-profile radiating antenna is widely applied to the phased array antenna.

SUMMARY

In order to overcome the shortcomings and defects in the prior art, the present invention provides a coupling-offset path branch and a high-isolation millimeter-wave phased array antenna based on the same. The present invention not only has characteristics of high isolation, a small size, and a simple structure, but also is capable of ensuring improvement of an active standing-wave ratio and a scanning performance of the phased array antenna.

The objective of the present invention is achieved by at least one of the following technical solutions.

A coupling-offset path branch includes two or more first grounded vias and one or more metal strips;

when the coupling-offset path branch is composed of two first grounded vias and one metal strip, the two first grounded vias are symmetrically placed along a center of the one metal strip; when the coupling-offset path branch is composed of a plurality of first grounded vias and a plurality of metal strips, every two first grounded vias are symmetrically placed along a center of one metal strip, and the plurality of metal strips are placed in parallel. The coupling-offset path branch composed of the plurality of first grounded vias and the plurality of metal strips is capable of providing higher isolation.

Further, the first grounded vias is a cuboid or a cylinder; and the metal strip is capable of being π-shaped, n-shaped, H-shaped, L-shaped, or M-shaped.

Further, the coupling-offset path branch is capable of being used in high-isolation array antennas including a microstrip patch antenna, a slot antenna, a metasurface antenna, an electric dipole antenna, an electromagnetic dipole antenna, a monopole antenna, a planar aperture antenna, or an on-chip antenna array.

A high-isolation millimeter-wave phased array antenna based on the coupling-offset path branch includes a plurality of radiating stacked microstrip patch elements, a shielding metal wall, several coupling-offset path branches, a metal ground plane, a feeding network layer, a first port, and a second port.

The radiating stacked microstrip patch element is located on an uppermost layer, The coupling-offset path branch is located between different radiating stacked microstrip patch elements. The feeding network layer is located on a lowermost layer. The metal ground plane is arranged between the radiating stacked microstrip patch element and the feeding network layer, and an I-shaped slot is etched in the metal ground plane. The first port and the second port are respectively located on a center line of a corresponding radiating stacked microstrip patch element. The first port is excited, and energy of the feeding network layer is coupled to the corresponding radiating stacked microstrip patch element through the I-shaped slot, and the energy is transmitted to the second port adjacent to the first port through an inherent coupling path portion. The coupling-offset path branch is introduced to offset the inherent coupling path, thus achieving a high-isolation effect between the first port and the second port.

Further, the coupling-offset path branch is symmetrically placed between different radiating stacked microstrip patch elements along an x axis; the metal strip in the coupling-offset path branch is parallel or perpendicular to a polarization direction of the radiating stacked microstrip patch element, and the first grounded vias in the coupling-offset path branch are symmetrically placed along the center of the metal strip; an amplitude and a phase of the introduced coupling-offset path are controlled by adjusting a height and a size of the coupling-offset path branch, so as to achieve conditions that the amplitude is consistent with that of the inherent coupling path and the phase is opposite to that of the inherent coupling path, so that the coupling-offset path and the inherent coupling path offset each other, thus achieving the high-isolation effect between the first port and the second port; and the plurality of radiating stacked microstrip patch elements are placed along the x axis, and a distance between the radiating stacked microstrip patch elements is calculated according to an array factor formula.

Further, the feeding network layer includes a strip line feeding network, a microstrip line feeding network, a substrate integrated waveguide feeding network, or a coplanar waveguide feeding network.

Further, the I-shaped slot corresponds to the center of the radiating stacked microstrip patch element, and since the I-shaped slot is in linearly polarized excitation, the high-isolation millimeter-wave phased array antenna is in linearly polarized radiation.

Further, the shielding metal wall includes a plurality of second grounded vias, and the plurality of second grounded vias are symmetrically placed around the I-shaped slot to form a cubic cavity for reducing field diffusion of the I-shaped slot; and a plurality of third grounded vias are placed on a bisector of the I-shaped slot to improve matching of the I-shaped slot.

Further, the coupling-offset path branch mainly solves coupling between two adjacent ports, so that the coupling-offset path branch is capable of being extended to a larger-scale high-isolation millimeter-wave phased array antenna according to a binary array arrangement scheme; and the coupling-offset path branch is placed between the radiating stacked microstrip patch elements which need decoupling.

Further, substrates adopted by the radiating stacked microstrip patch element and the feeding network layer include a low-temperature co-fired ceramic substrate or a PCB dielectric substrate.

Compared with the prior art, the present invention has the following beneficial effects.

(1) The present invention includes the radiating stacked microstrip patch, the feeding network, and the decoupling branch based on the coupling-offset path. By adopting the simple decoupling branch, the present invention can achieve a high-isolation effect of a broadband, improves an active standing-wave ratio in a working frequency band and a scanning capability of the array antenna, and also has the advantages of compact structure and simple design.

(2) By adopting the decoupling branch based on the coupling-offset path, the present invention has an expandable characteristic, and can be widely applied to decouple arrays of different amount and different polarizations.

(3) By adjusting the height, the length, and the width of the decoupling branch, the present invention can control the amplitude and the phase of the introduced coupling, so that isolation between the antenna elements or antenna subarrays is enhanced.

(4) By adopting the plurality of decoupling branches based on the coupling-offset path, the present invention enhances the isolation between the antenna elements or the antenna subarrays.

(5) By adopting the stacked microstrip patch, the present invention implements a broadband matching characteristic.

(6) The feeding network of the present invention can implement equal-pair and equal-phase port excitation in the working frequency band.

(7) The present invention is simple in structure and easy in processing, and has relatively small cost and weight, thus being capable of being produced on a large scale.

DESCRIPTION OF THE EMBODIMENTS

The specific implementations of the present invention are further described in detail hereinafter with reference to the embodiments and the accompanying drawings, but the implementations of the present invention are not limited to this.

Embodiment 1

In the present embodiment, a coupling-offset path branch 3 includes a pair of first grounded vias 4 and one π-shaped metal strip 5.

Figure 1A:
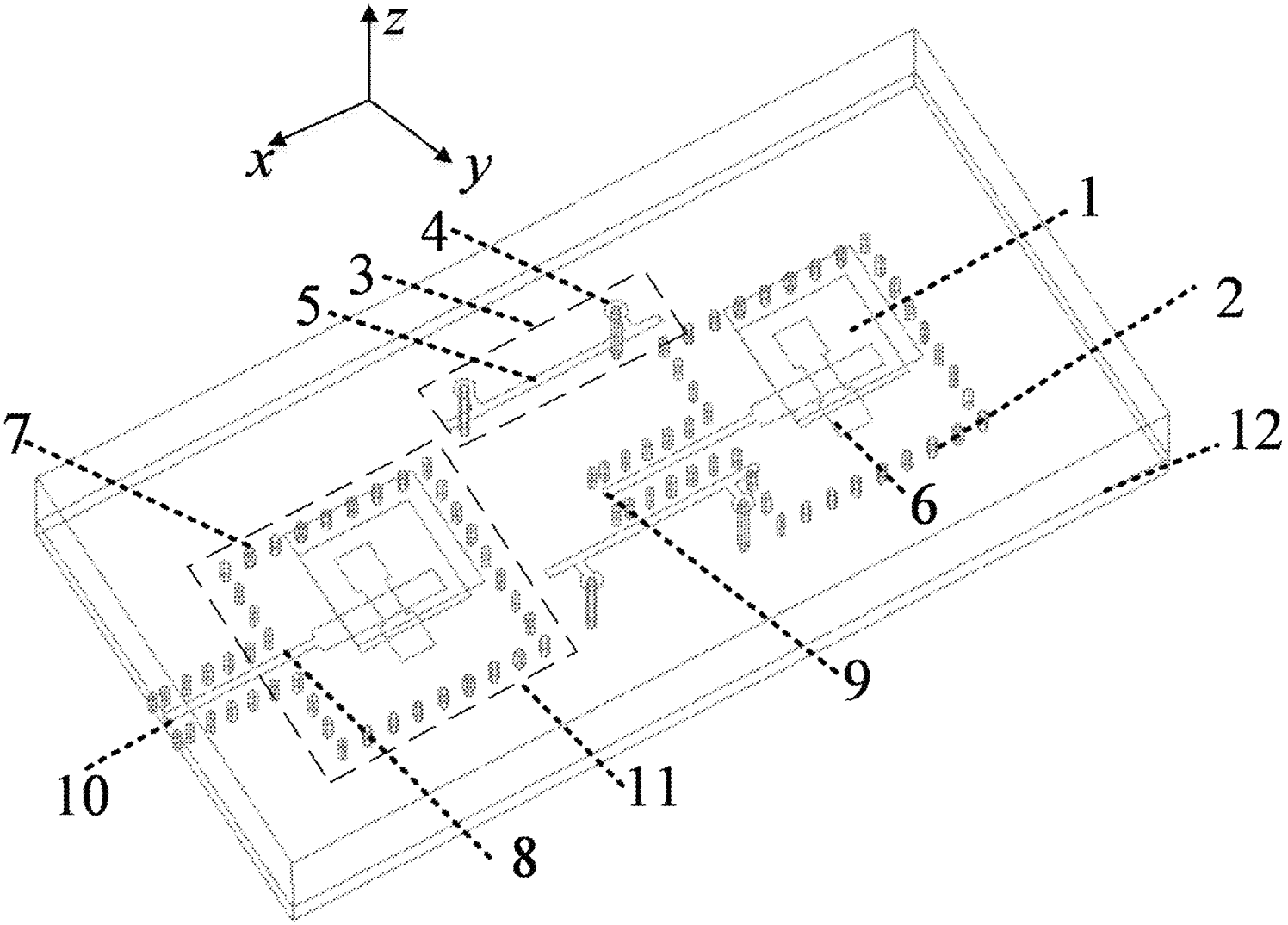
FIG. 1*a* is a schematic three-dimensional structural diagram of a high-isolation binary array antenna arranged along a polarized radiation direction in Embodiment 1 of the present invention.
Figure 1B:
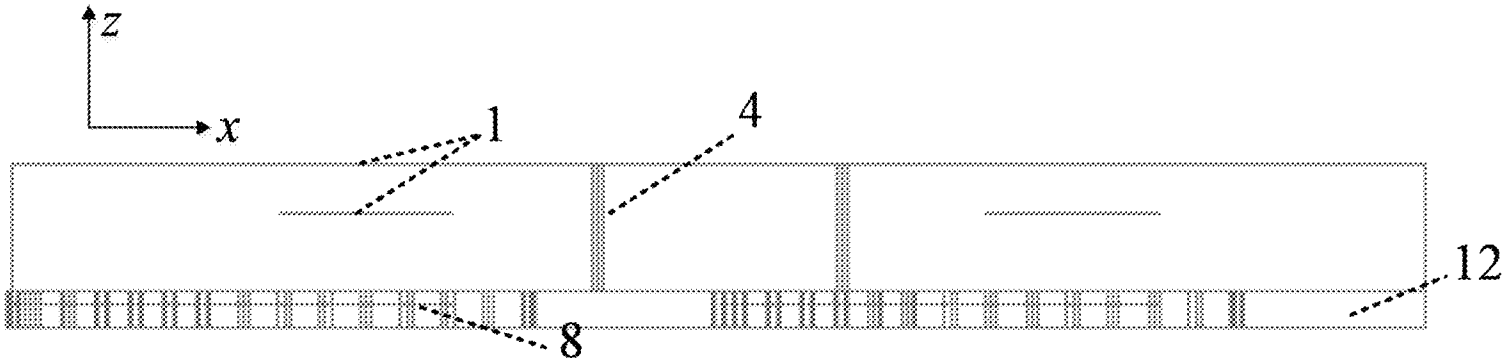
FIG. 1*b* is a schematic cross-sectional diagram of the high-isolation binary array antenna in Embodiment 1 of the present invention.

In the present embodiment, as shown in FIG. 1*a* and FIG. 1*b*, a high-isolation millimeter-wave phased array antenna includes two radiating stacked microstrip patch elements 1 and two coupling-offset path branches 3, which forms a high-isolation millimeter-wave binary antenna array based on the coupling-offset path.

In the high-isolation millimeter-wave binary antenna array based on the coupling-offset path, the two radiating stacked microstrip patch elements 1 are respectively provided with a first port 9 and a second port 10, and the first port 9 and the second port 10 are respectively located on a center line of a corresponding radiating stacked microstrip patch element 1. The first port 9 is excited, and energy of a feeding network layer 11 is coupled to the radiating stacked microstrip patch element 1 through an I-shaped slot 6, and the energy is transmitted to the second port 10 through an inherent coupling path portion. The coupling-offset path branch 3 is introduced to adjust an amplitude and a phase of the coupling path, so as to offset the inherent coupling path, thus implementing high-isolation between the first port 9 and the second port 10.

In the present embodiment, the radiating stacked microstrip patch element 1 and the feeding network layer 11 are both processed by a low-temperature co-fired ceramic process, and a dielectric substrate is Ferro A6ME. An X-axis direction of the dielectric substrate is vertical, a Y-axis direction of the dielectric substrate is horizontal, and an original point is a center point of the dielectric substrate. A direction of an XY coordinate system mentioned in the present embodiment is subject to the accompanying drawings.

In the present embodiment, a dielectric constant εr of the dielectric substrate is [1, 10.2], a thickness of the dielectric substrate is [0.01λ, 0.3λ], and a thickness of a metal ground plane is [0.005λ, 0.1λ], wherein λ is a free space wavelength.

Figure 2A:
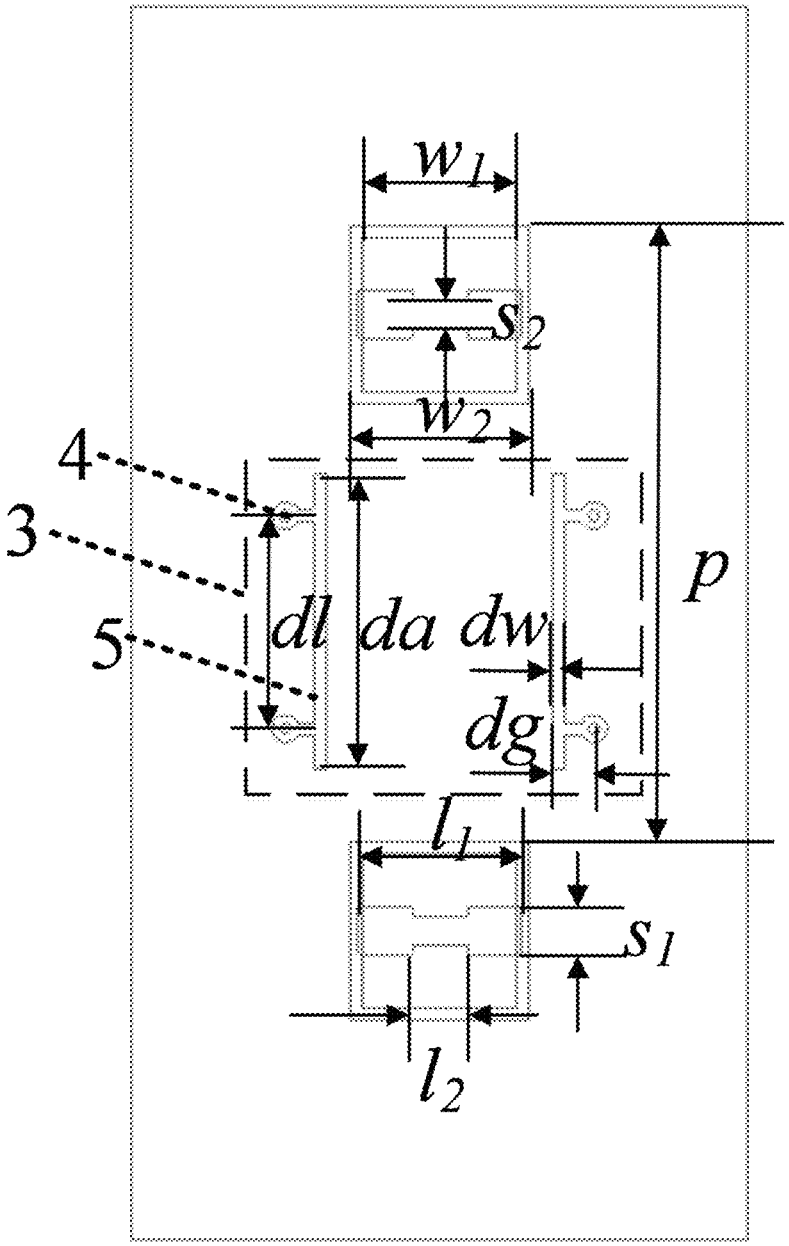
FIG. 2*a* is a top view of upper surfaces of a layer of a radiating stacked microstrip patch element (1) and a coupling-offset path in Embodiment 1 of the present invention.

As shown in FIG. 2*a*, in the present embodiment, two layers of radiating patch structures are printed on an upper surface of the radiating stacked microstrip patch element 1, and the radiating patch structure is composed of a square metal patch, which is excited by the I-shaped slot 6. The high-isolation millimeter-wave binary antenna array based on the coupling-offset path is arranged along an x-axis. That the original inherent coupling path is offset is implemented by adjusting heights, lengths, and widths of the first grounded vias 4 and the π-shaped metal strip 5, a distance between the first grounded vias 4, and by adjusting the phase and the amplitude of the introduced coupling-offset path, so as to decouple the binary array. A plurality of introduced coupling-offset path branches 3 may be provided, and the introduced coupling-offset path branches 3 may have different shapes for further adjusting the amplitudes and the phases of the coupling-offset path branches, so as to achieve a better decoupling effect.

Figure 2B:
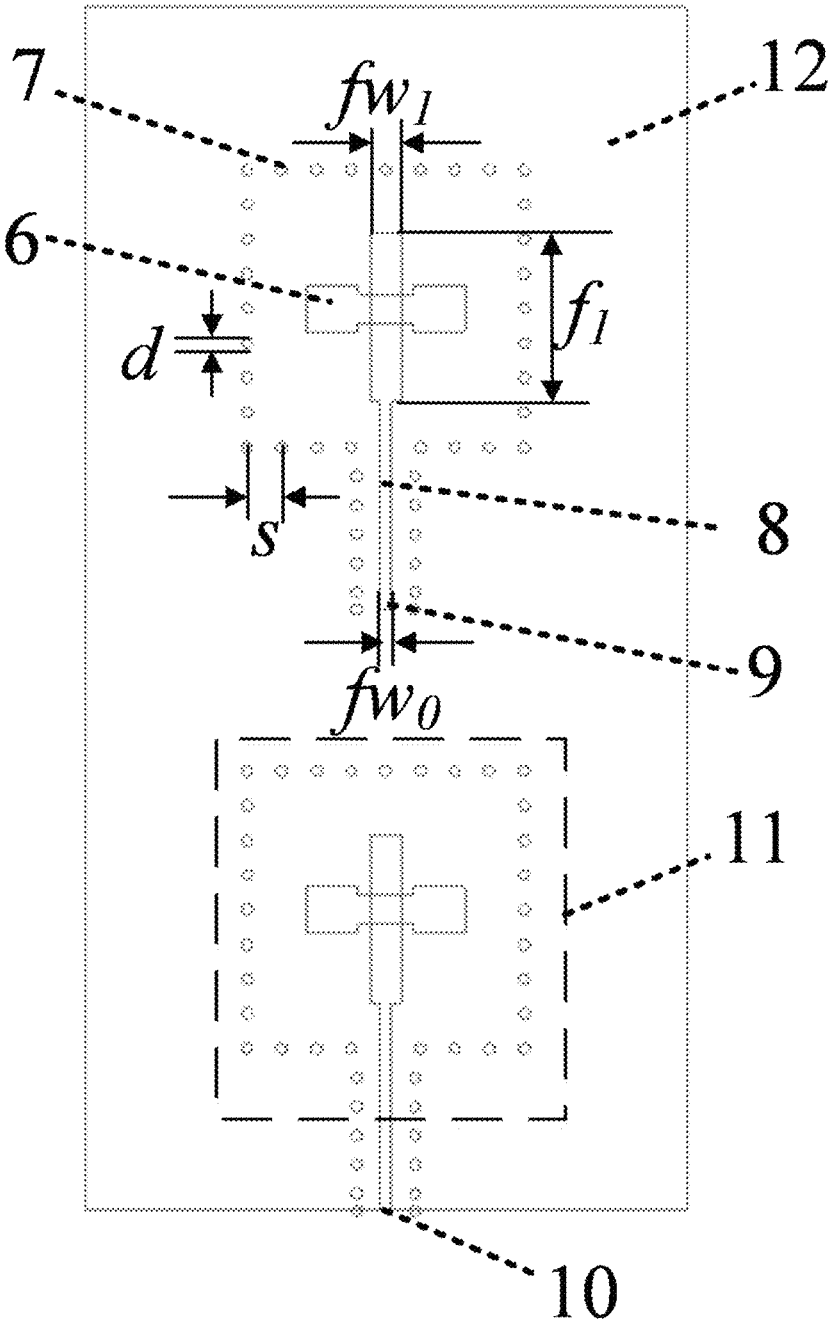
FIG. 2*b* is a bottom view of a lower surface of a feeding network in Embodiment 1 of the present invention.

As shown in FIG. 2*b*, in the metal ground plane 12, the I-shaped slot 6 is used as a slot. A second grounded vias 7 is added around the I-shaped slot 6 for shielding.

In the present embodiment, a transmission line of the feeding network layer 11 is in a form of a strip line.

As shown in FIG. 2*a*, a height of a patch of the radiating stacked microstrip patch element 1 is [0.01λ, 0.25λ], a size w1 of an upper patch of the radiating stacked microstrip patch element 1 is [0.1λ, 0.8λ], and a size w2 of a lower patch of the radiating stacked microstrip patch element is [0.2λ, 0.8λ]. A length l1 of the I-shaped slot 6 in the metal ground plane 12 is [0.1λ, 0.8λ], a length l2 of the I-shaped slot in the metal ground plane is [0.1λ, 0.8λ], a width s1 of the I-shaped slot 6 in the metal ground plane 12 is [0.001λ, 0.25λ], and a width s2 of the I-shaped slot in the metal ground plane is [0.001λ, 0.25λ]. A height of the coupling-offset path branch 3 is [0.01λ, 0.25λ], a distance dl between the pair of the first grounded vias 4 of the coupling-offset path branch 3 is [0.01λ, 0.6λ], a length da of the metal strip 5 of the coupling-offset path branch 3 is [0.1λ, 0.6λ], a width dw of the metal strip 5 of the coupling-offset path branch 3 is [0.001λ, 0.1λ], and a distance dg between the first grounded vias 4 and the metal strip 5 of the coupling-offset path branch 3 is [0.001λ, 0.6λ]. As shown in FIG. 2*b*, a width fw of a step impedance line in the feeding network layer 11 is [0.001λ, 0.2λ], a length fl of the step impedance line in the feeding network layer 11 is [0.01λ, 0.5λ], a width fw0 of a port strip line in the feeding network layer 11 is [0.001λ, 0.1λ], a distance s between metal grounded vias in the feeding network layer 11 is [0.001λ, 0.1λ], and a diameter d of the metal grounded vias in the feeding network layer 11 is [0.001λ, 0.1λ], wherein λ is a free space wavelength.

In the present embodiment, a specific size of the high-isolation millimeter-wave binary antenna array based on the coupling-offset path is as follows.

As shown in FIG. 2*a*, the height of the patch of the radiating stacked microstrip patch element 1 is 0.94 mm, the size w1 of the upper patch of the radiating stacked microstrip patch element 1 is 1.5 mm, and the size w2 of the lower patch of the radiating stacked microstrip patch element is 1.3 mm. The length l1 of the I-shaped slot 6 in the metal ground plane 12 is 1.37 mm, the length l2 of the I-shaped slot 6 in the metal ground plane is 0.47 mm, the width s1 of the I-shaped slot 6 in the metal ground plane 12 is 0.4 mm, and the width s2 of the I-shaped slot in the metal ground plane is 0.25 mm. The height of the coupling-offset path branch 3 is 0.94 mm, the distance dl between the pair of the first grounded vias 4 of the coupling-offset path branch 3 is 1.8 mm, the length da of the metal strip 5 of the coupling-offset path branch 3 is 2.5 mm, the width dw of the metal strip 5 of the coupling-offset path branch 3 is 0.1 mm, and the distance dg between the first grounded vias 4 and the metal strip 5 of the coupling-offset path branch 3 is 0.325 mm. As shown in FIG. 2*b*, the width fw of the step impedance line in the feeding network layer 11 is 0.27 mm, the length f1 of the step impedance line in the feeding network layer 11 is 1.45 mm, the width fw0 of the port strip line in the feeding network layer 11 is 0.1 mm, the distance s between the metal grounded vias in the feeding network layer 11 is 0.3 mm, and the diameter d of the metal grounded vias in the feeding network layer 11 is 0.1 mm.

Figure 3:
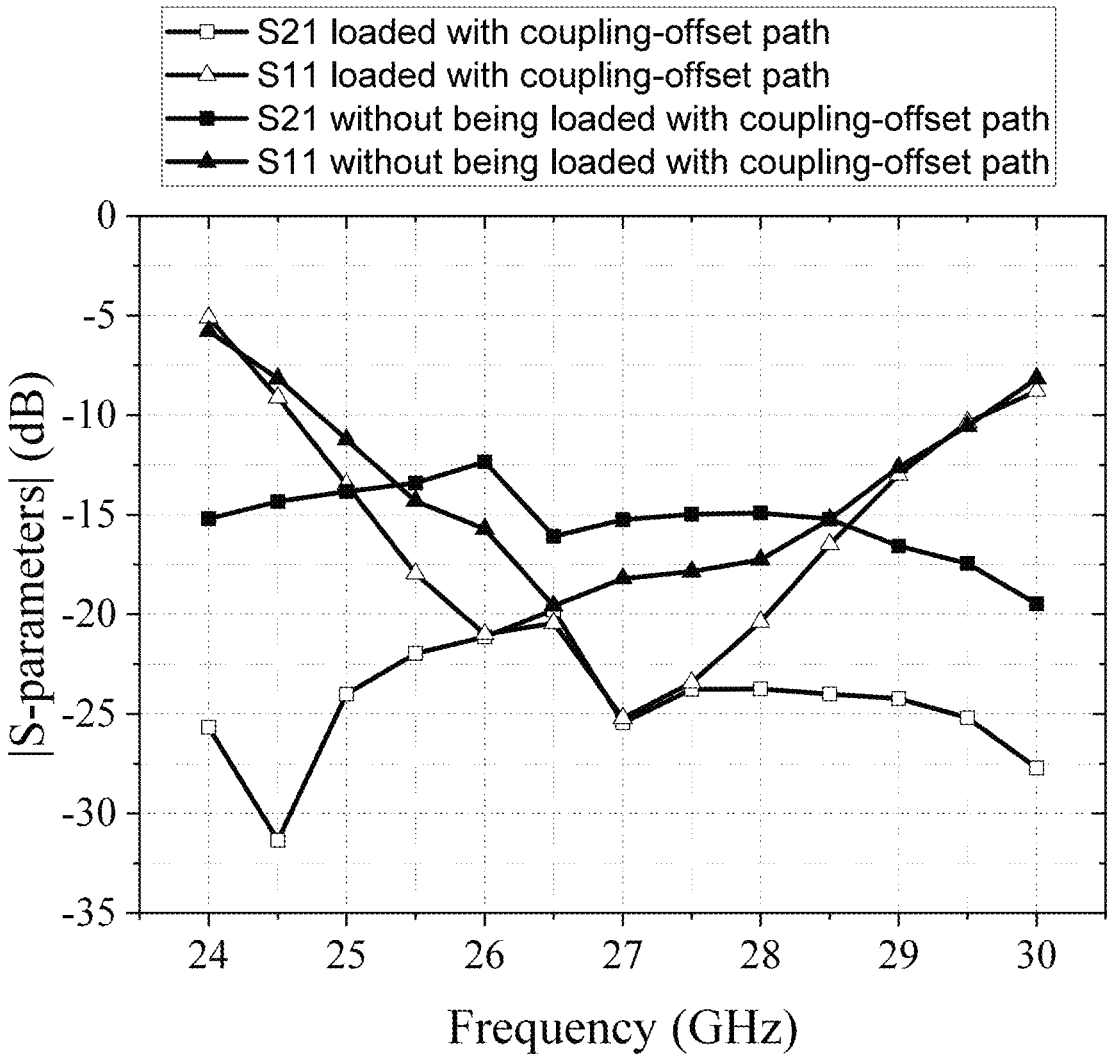
FIG. 3 is a schematic diagram of S parameters of the binary array antenna in Embodiment 1 of the present invention before and after decoupling.

As shown in FIG. 3, a working frequency band of the high-isolation millimeter-wave binary antenna array based on the coupling-offset path is 24.75 GHz to 29.5 GHz, in-band S11 is lower than −10 dB, and in-band polarization isolation is only 12.5 dB before decoupling. After decoupling based on the coupling-offset path, the in-band isolation is greater than 20 dB, and the isolation is improved by 7.5 dB maximumly.

Figure 4:
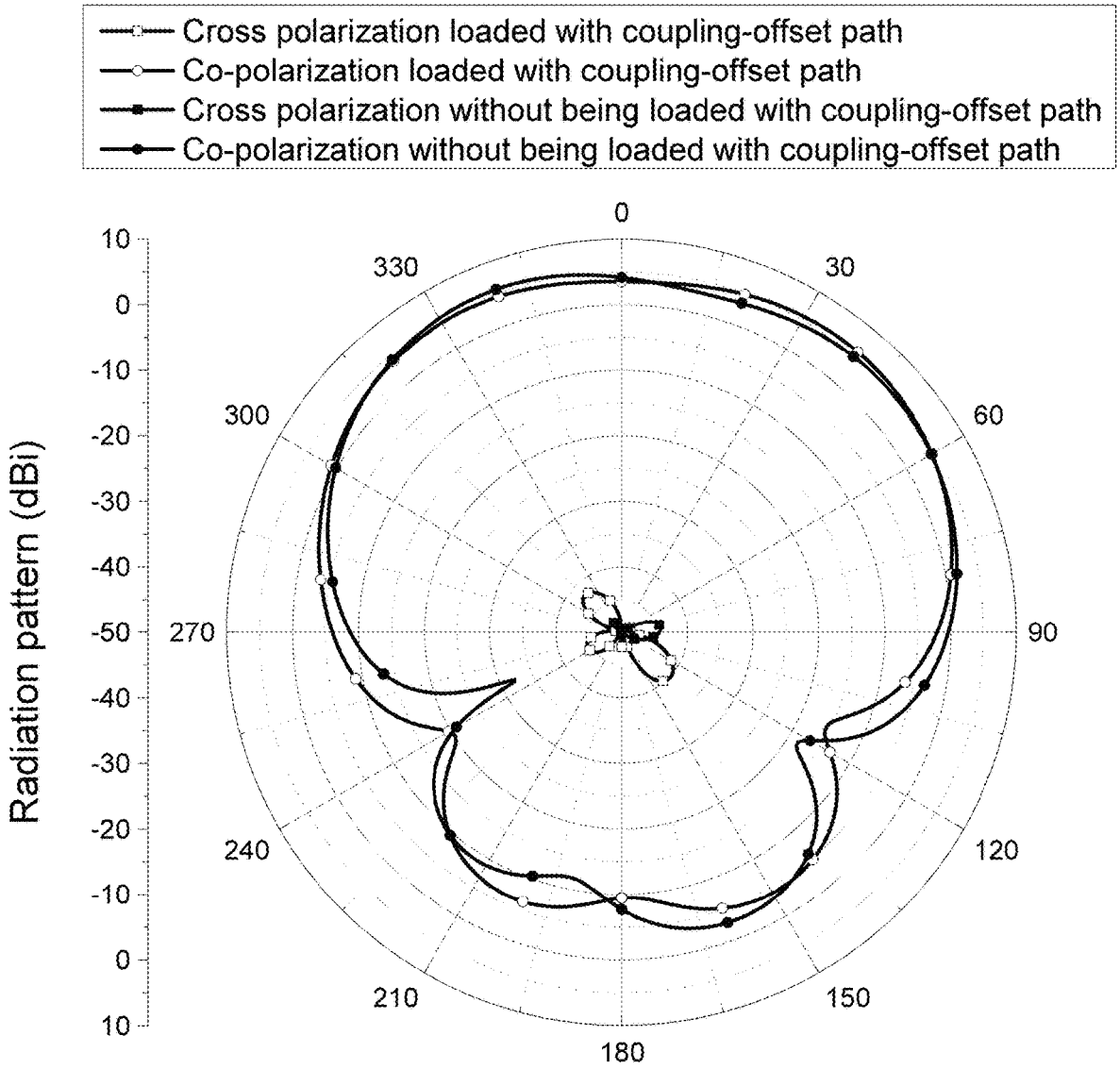
FIG. 4 is a direction diagram of an xoz plane of the binary array antenna in Embodiment 1 of the present invention at 28 GHz.
Figure 5:
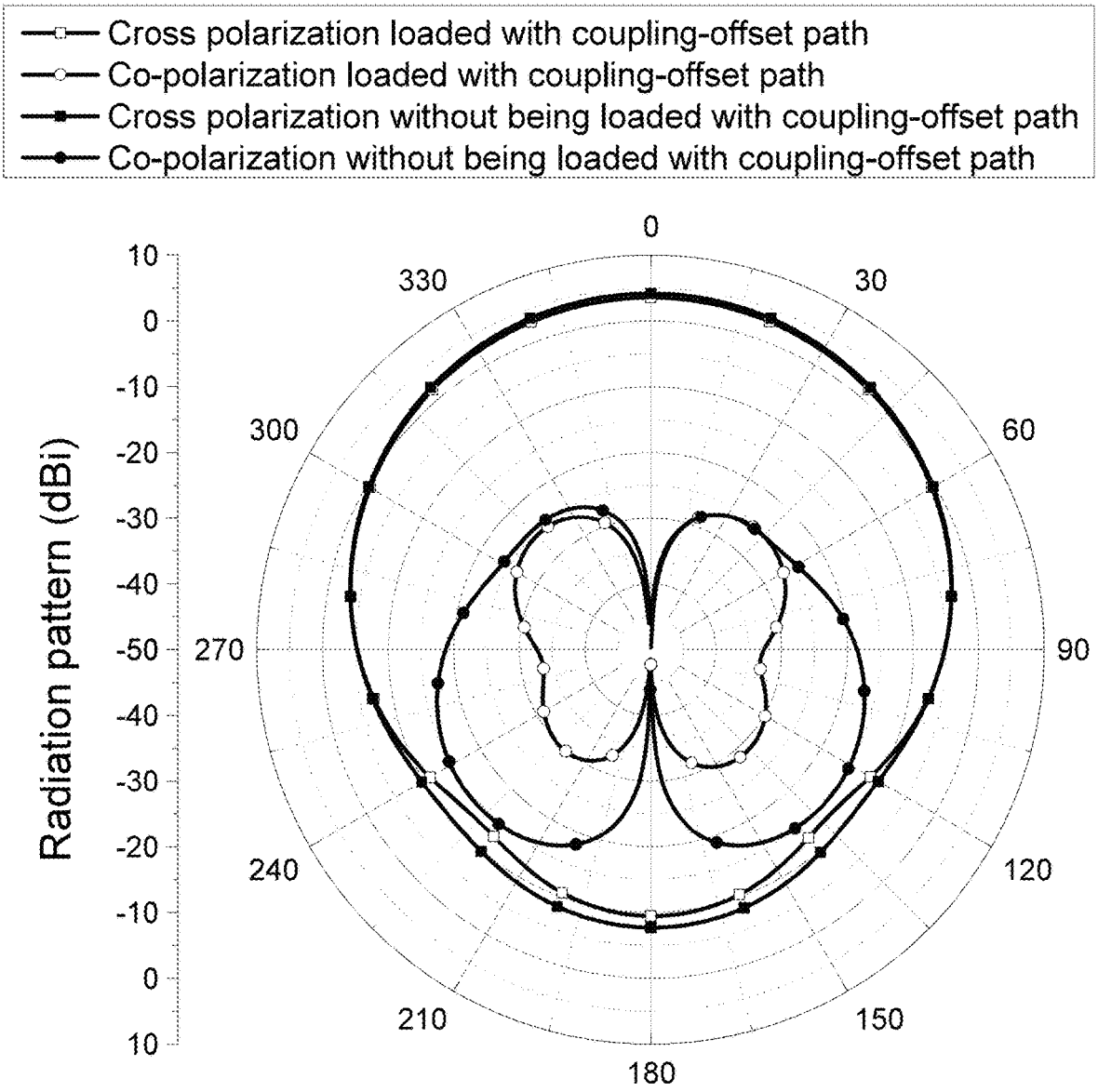
FIG. 5 is a direction diagram of a yoz plane of the binary array antenna in Embodiment 1 of the present invention at 28 GHz.

As shown in FIG. 4 and FIG. 5, for the high-isolation millimeter-wave binary antenna array based on the coupling-offset path, a direction diagram of the element is deviated to the left before decoupling, and the direction diagram of the element is basically not deviated after decoupling, so that a symmetry becomes better. In addition, cross polarizations before and after decoupling are both lower than −40 dB.

It can be seen from the above that the high-isolation millimeter-wave binary array antenna based on the coupling-offset path according to the present invention effectively implements characteristics of high-isolation and direction diagram improvement, and has a working frequency band greater than 18%.

Embodiment 2

In the present embodiment, a coupling-offset path branch 3 includes two pairs of first grounded vias 4 and two π-shaped metal strips 5.

Figure 6A:
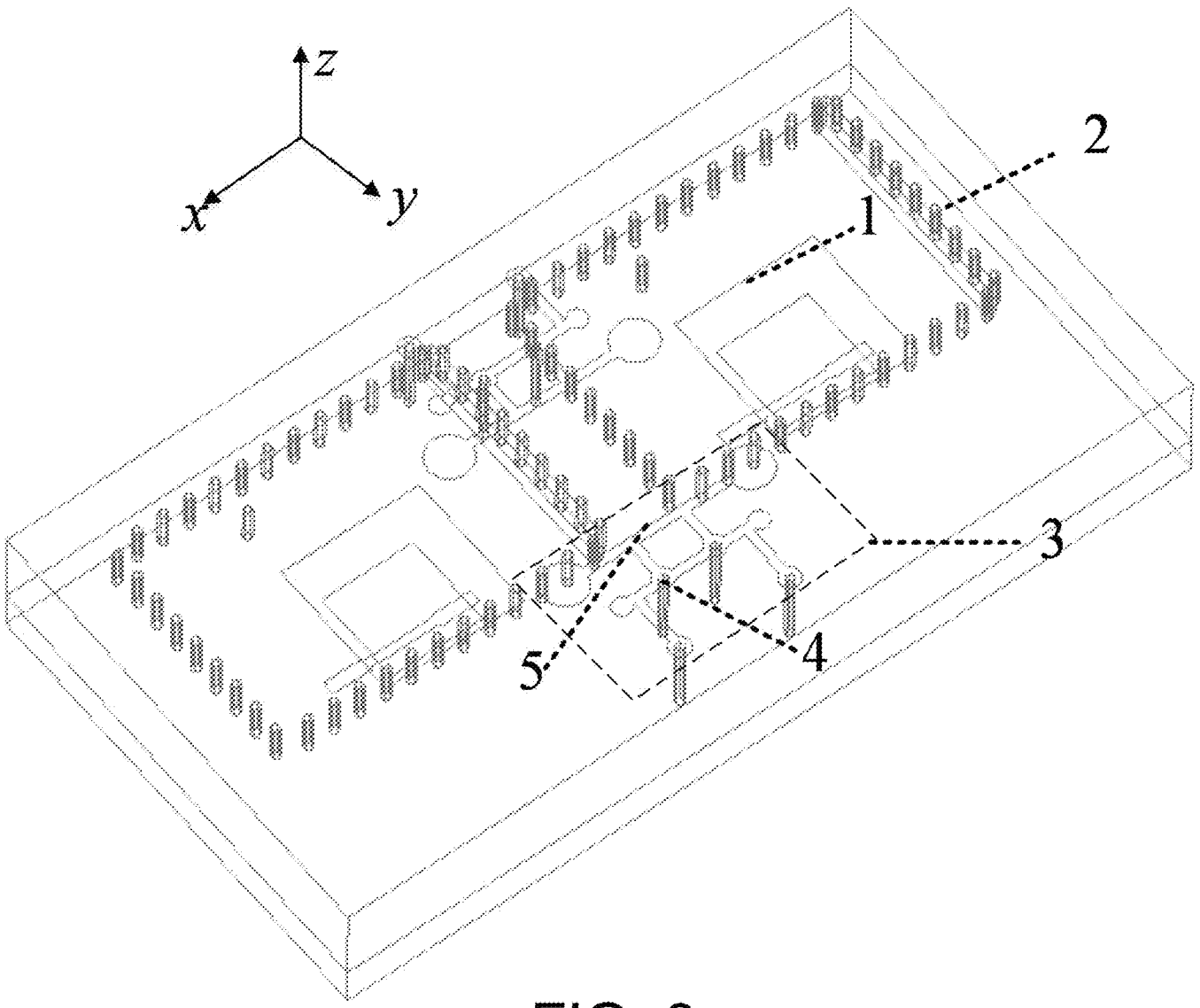
FIG. 6*a* is a schematic three-dimensional structural diagram of a high-isolation binary array antenna arranged perpendicular to a polarized radiation direction in Embodiment 2 of the present invention.
Figure 6B:
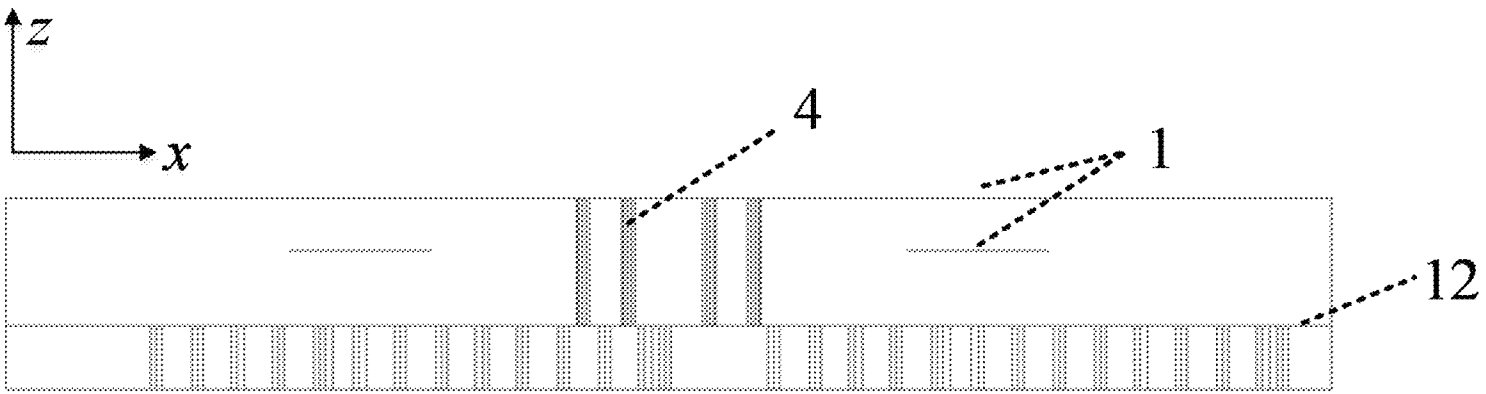
FIG. 6*b* is a schematic cross-sectional diagram of the high-isolation binary array antenna in Embodiment 2 of the present invention.

In the present embodiment, as shown in FIG. 6*a* and FIG. 6*b*, a high-isolation millimeter-wave phased array antenna includes two radiating stacked microstrip patch elements 1 and two coupling-offset path branches 3, which forms a high-isolation millimeter-wave binary antenna array based on the coupling-offset path.

In the high-isolation millimeter-wave binary antenna array based on the coupling-offset path, the two radiating stacked microstrip patch elements 1 are respectively provided with a first port 9 and a second port 10, and the first port 9 and the second port 10 are respectively located on a center line of a corresponding radiating stacked microstrip patch element 1. The first port 9 is excited, energy of a feeding network layer 11 is coupled to the radiating stacked microstrip patch element 1 through an I-shaped slot 6, and the energy is transmitted to the second port 10 through an inherent coupling path portion. The coupling-offset path branch 3 is introduced to adjust an amplitude and a phase of the coupling path, so as to offset the inherent coupling path, thus implementing high-isolation between the first port 9 and the second port 10.

In the present embodiment, the radiating stacked microstrip patch element 1 and the feeding network layer 11 are both processed by a low-temperature co-fired ceramic process, and a dielectric substrate is Ferro A6ME. An X-axis direction of the dielectric substrate is vertical, a Y-axis direction of the dielectric substrate is horizontal, and an original point is a center point of the dielectric substrate. A direction of an XY coordinate system mentioned in the present embodiment is subject to the accompanying drawings.

In the present embodiment, a dielectric constant εr of the dielectric substrate is [1,10.2], a thickness of the dielectric substrate is [0.01λ, 0.3λ], and a thickness of a metal ground plane is [0.005λ, 0.1λ], wherein λ is a free space wavelength.

Figure 7A:
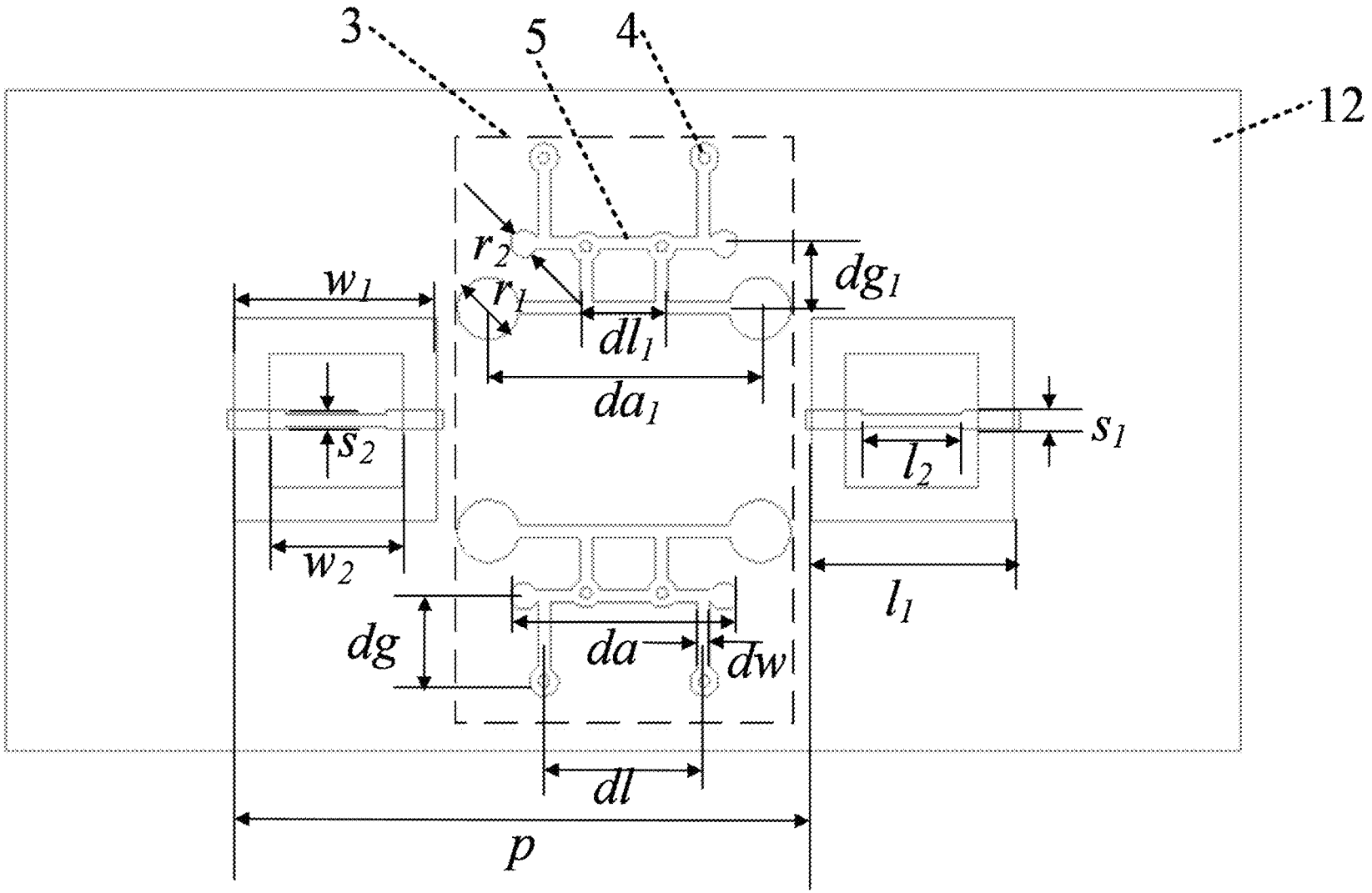
FIG. 7*a* is a top view of upper surfaces of a layer of a radiating stacked microstrip patch element (1) and a coupling-offset path in Embodiment 2 of the present invention.

As shown in FIG. 7*a*, in the present embodiment, two layers of radiating patch structures are printed on an upper surface of the radiating stacked microstrip patch element 1, and the radiating patch structure is composed of a square metal patch, which is excited by the I-shaped slot 6. The high-isolation millimeter-wave binary antenna array based on the coupling-offset path is arranged along an x-axis. The introduced coupling-offset path branch 3 includes two pairs of first grounded vias 4 and two cascaded π-shaped metal strips 5. An end of the π-shaped metal strip 5 is loaded with a circular metal patch. The phase and the amplitude of the introduced coupling-offset path are adjusted by adjusting heights, lengths, and widths of the first grounded vias 4 and the π-shaped metal strips 5, and a distance between the first grounded vias 4, and the phase and the amplitude of the introduced coupling-offset path, such that the original inherent coupling path is offset, so as to decouple the binary array. A plurality of introduced coupling-offset path branches 3 may be provided, and the introduced coupling-offset path branches 3 may have different shapes for further adjusting the amplitudes and the phases of the coupling-offset path branches, so as to achieve a better decoupling effect.

Figure 7B:
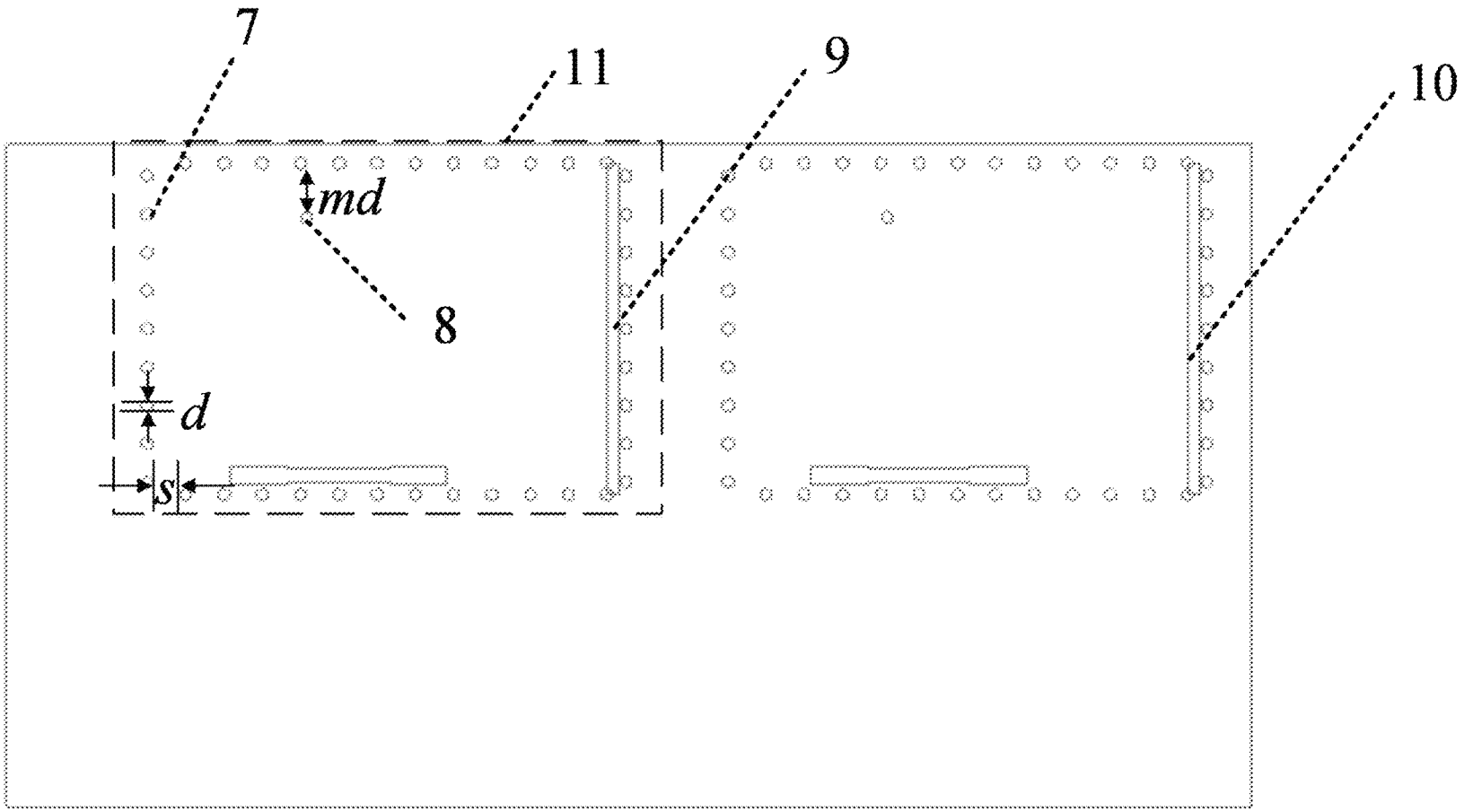
FIG. 7*b* is a bottom view of a lower surface of a feeding network in Embodiment 2 of the present invention.

As shown in FIG. 7*b*, in the metal ground plane 12, the I-shaped slot 6 is used as a slot. A second grounded vias 7 is added around the I-shaped slot 6 for shielding. A position of the third grounded vias 8 is adjusted to improve impedance matching.

In the present embodiment, a transmission line of the feeding network layer 11 is in a form of substrate integrated waveguide.

As shown in FIG. 7*a*, a height of a patch of the radiating stacked microstrip patch element 1 is [0.01λ, 0.25λ], a size w1 of an upper patch of the radiating stacked microstrip patch element 1 is [0.1λ, 0.8λ], and a size w2 of a lower patch of the radiating stacked microstrip patch element is [0.2λ, 0.8λ]. A length l1 of the I-shaped slot 6 in the metal ground plane 12 is [0.1λ, 0.8λ], a length l2 of the I-shaped slot in the metal ground plane is [0.1λ, 0.8λ], a width s1 of the I-shaped slot 6 in the metal ground plane 12 is [0.001λ, 0.25λ], and a width s2 of the I-shaped slot in the metal ground plane is [0.001λ, 0.25λ]. A height of the coupling-offset path branch 3 is [0.01λ, 0.25λ], a distance dl between one pair of the first grounded vias 4 of the coupling-offset path branch 3 is [0.01λ, 0.6λ], a distance dl1 between the other pair of first grounded vias 4 of the coupling-offset path branch is [0.01λ, 0.6λ], a length da of one metal strip 5 of the coupling-offset path branch 3 is [0.1λ, 0.6λ], a length da1 of the other metal strip 5 of the coupling-offset path branch is [0.1λ, 06λ], a width dw of the metal strip 5 of the coupling-offset path branch 3 is [0.001λ, 0.1λ], a distance dg between the first grounded vias 4 and the metal strip 5 of the coupling-offset path branch 3 is [0.001λ, 0.6λ], and a distance dg1 between the first grounded vias and the metal strip of the coupling-offset path branch is [0.001λ, 0.6λ]. As shown in FIG. 7*b*, a distance s between metal grounded vias in the feeding network layer 11 is [0.001λ, 0.1λ], a diameter d of the metal grounded vias in the feeding network layer 11 is [0.001λ, 0.1λ], and a distance and between the third grounded vias 8 and the feeding network layer 11 is [0.001λ, 0.1λ], wherein λ is a free space wavelength.

In the present embodiment, a specific size of the high-isolation millimeter-wave binary antenna array based on the coupling-offset path is as follows.

As shown in FIG. 7*a*, the height of the patch of the radiating stacked microstrip patch element 1 is 0.94 mm, the size w1 of the upper patch of the radiating stacked microstrip patch element 1 is 1.5 mm, and the size w2 of the lower patch of the radiating stacked microstrip patch element is 1.055 mm. The length l1 of the I-shaped slot 6 in the metal ground plane 12 is 1.7 mm, the length l2 of the I-shaped slot in the metal ground plane is 0.8 mm, the width s1 of the I-shaped slot 6 in the metal ground plane 12 is 0.15 mm, and the width s2 of the I-shaped slot in the metal ground plane is 0.125 mm. The height of the coupling-offset path branch 3 is 0.94 mm, the distance dl between one pair of the first grounded vias 4 of the coupling-offset path branch 3 is 1.26 mm, the distance dl1 between the other pair of first grounded vias 4 of the coupling-offset path branch is 0.6 mm, the length da of one metal strip 5 of the coupling-offset path branch 3 is 1.7 mm, the length da1 of the other metal strip 5 of the coupling-offset path branch is 2.19 mm, the width dw of the metal strip 5 of the coupling-offset path branch 3 is 0.1 mm, the distance dg between the first grounded vias 4 and the metal strip 5 of the coupling-offset path branch 3 is 0.675 mm, and the distance dg1 between the first grounded vias and the metal strip of the coupling-offset path branch is 0.5 mm. As shown in FIG. 7*b*, the distance s between metal grounded vias in the feeding network layer 11 is 0.3 mm, the diameter d of the metal grounded vias in the feeding network layer 11 is 0.1 mm, and the distance and between the third grounded vias 8 and the feeding network layer 11 is 0.42 mm.

Figure 8:
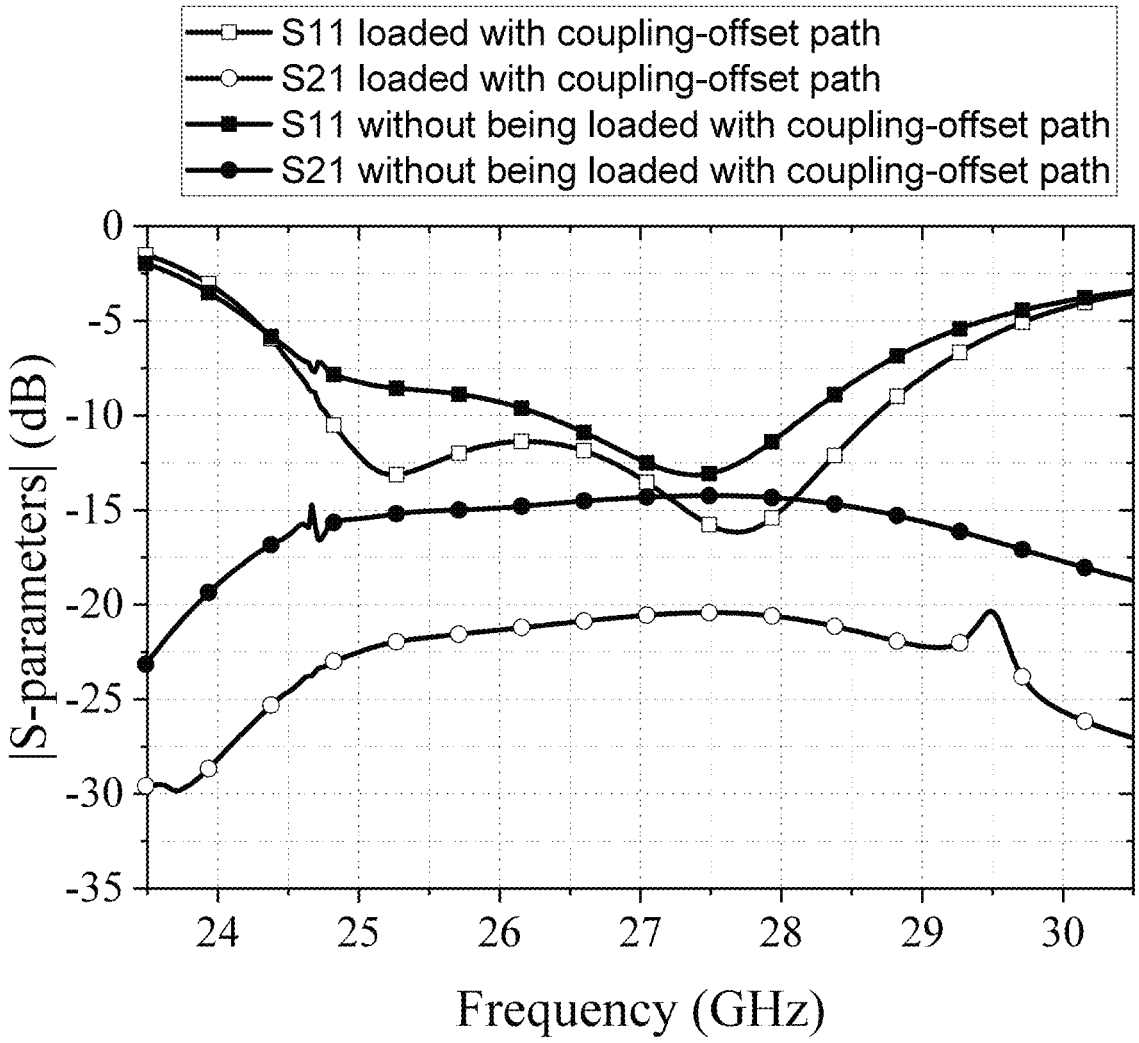
FIG. 8 is a result graph of S parameters of the binary array antenna in Embodiment 2 of the present invention before and after decoupling.

As shown in FIG. 8, a working frequency band of the high-isolation millimeter-wave binary antenna array based on the coupling-offset path without decoupling is 26.28 GHz to 28.15 GHz, in-band S11 is lower than −10 dB, and in-band polarization isolation is only 14 dB before decoupling. After decoupling based on the coupling-offset path, the working frequency band is 24.8 GHz to 28.67 GHz, the in-band S11 is lower than −10 dB, the in-band isolation is greater than 20 dB, and the isolation is improved by 6 dB maximumly.

Figure 9:
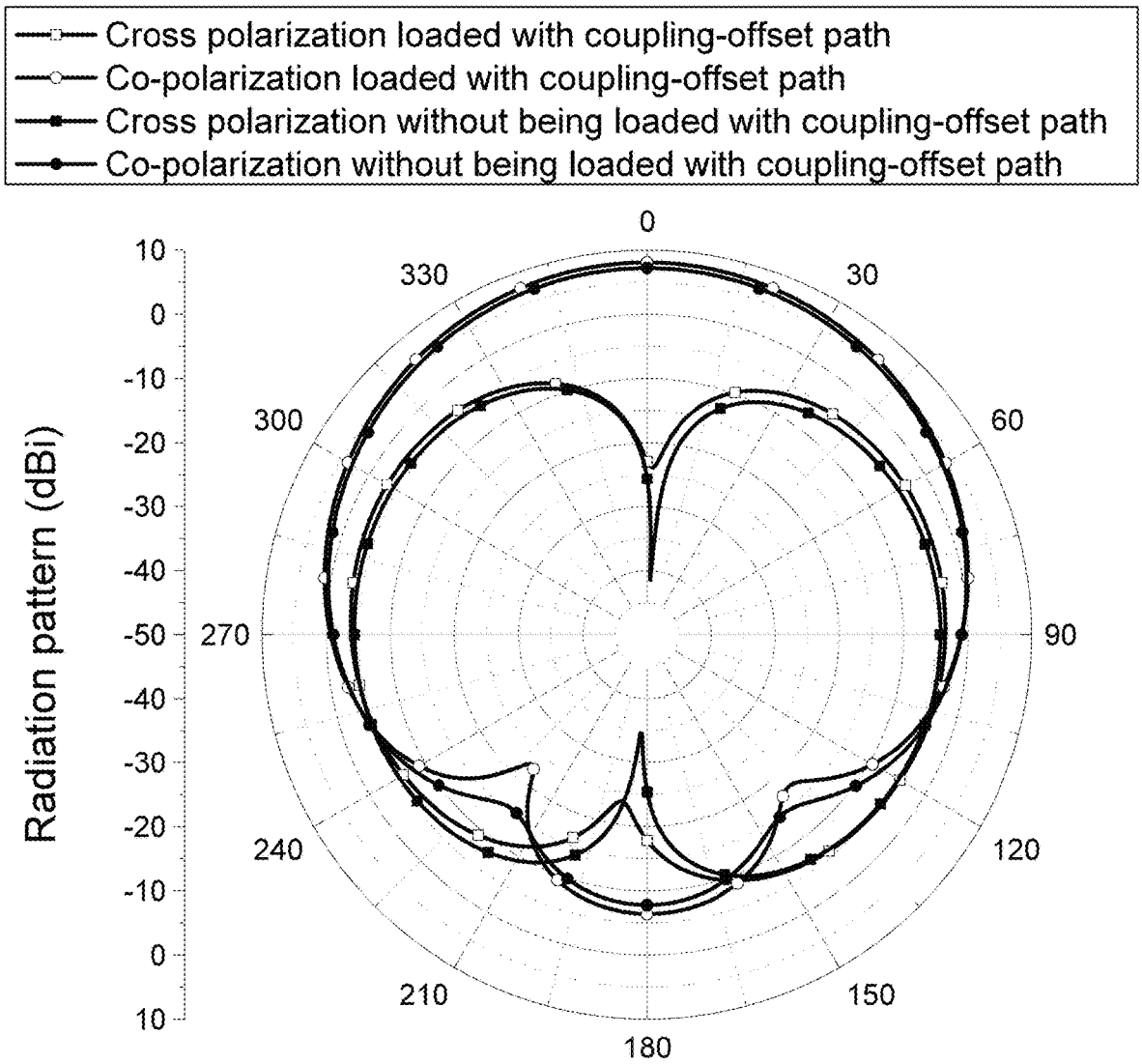
FIG. 9 is a direction diagram of an xoz plane of the binary array antenna in Embodiment 2 of the present invention at 28 GHz.
Figure 10:
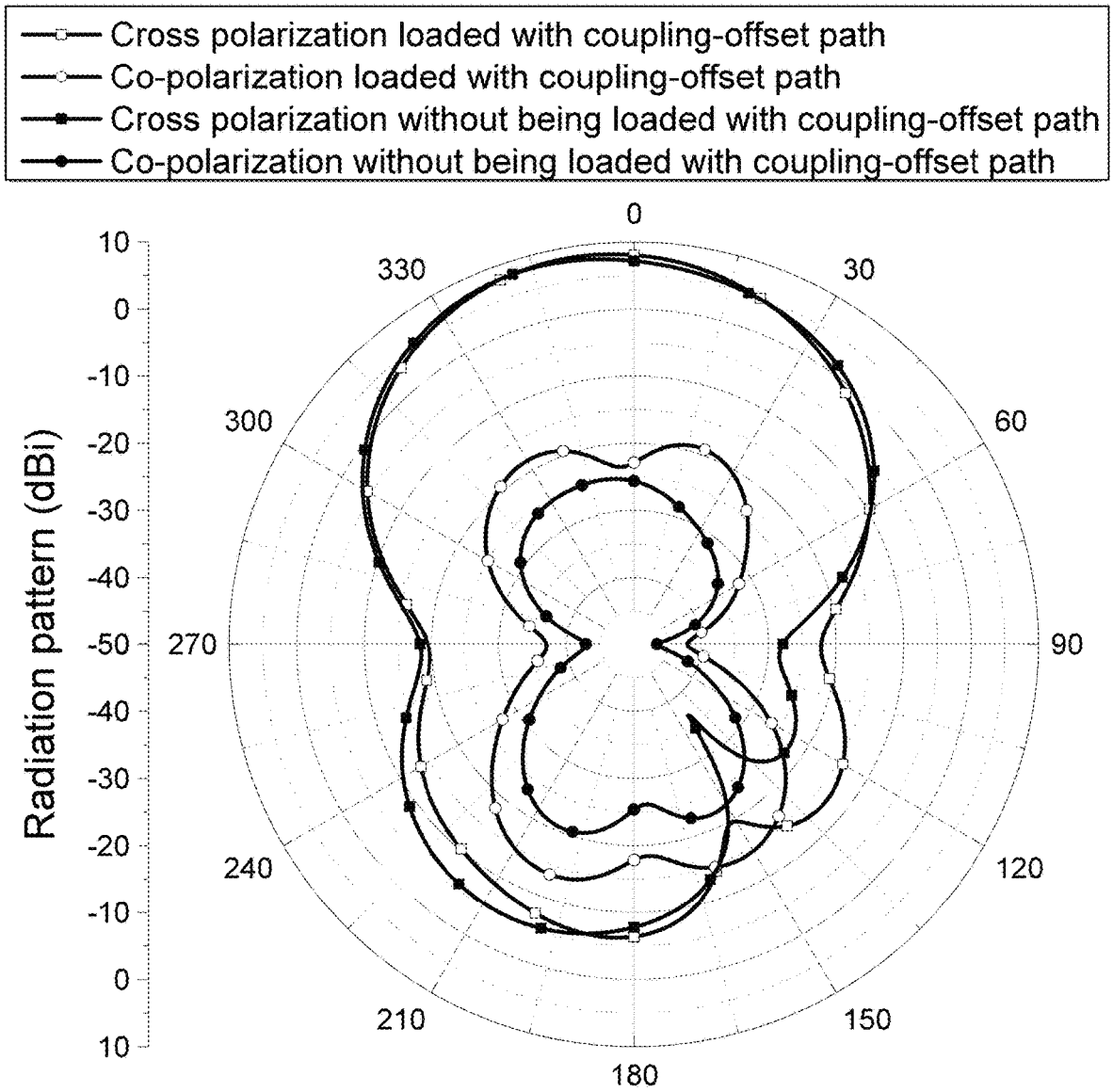
FIG. 10 is a direction diagram of a yoz plane of the binary array antenna in Embodiment 2 of the present invention at 28 GHz.

As shown in FIG. 9 and FIG. 10, for the high-isolation millimeter-wave binary antenna array based on the coupling-offset path, a gain of the element is slightly increased by about 0.3 dB after decoupling, and cross-polarizations before and after decoupling are both lower than −25 dB.

It can be seen from the above that the high-isolation millimeter-wave binary array antenna based on the coupling-offset path effectively increases a matching bandwidth, implements characteristics of high-isolation and direction diagram improvement, and has a working frequency band greater than 15%.

Embodiment 3

In the present embodiment, a coupling-offset path branch 3 includes a pair of first grounded vias 4 and one π-shaped metal strip 5.

Figure 11A:
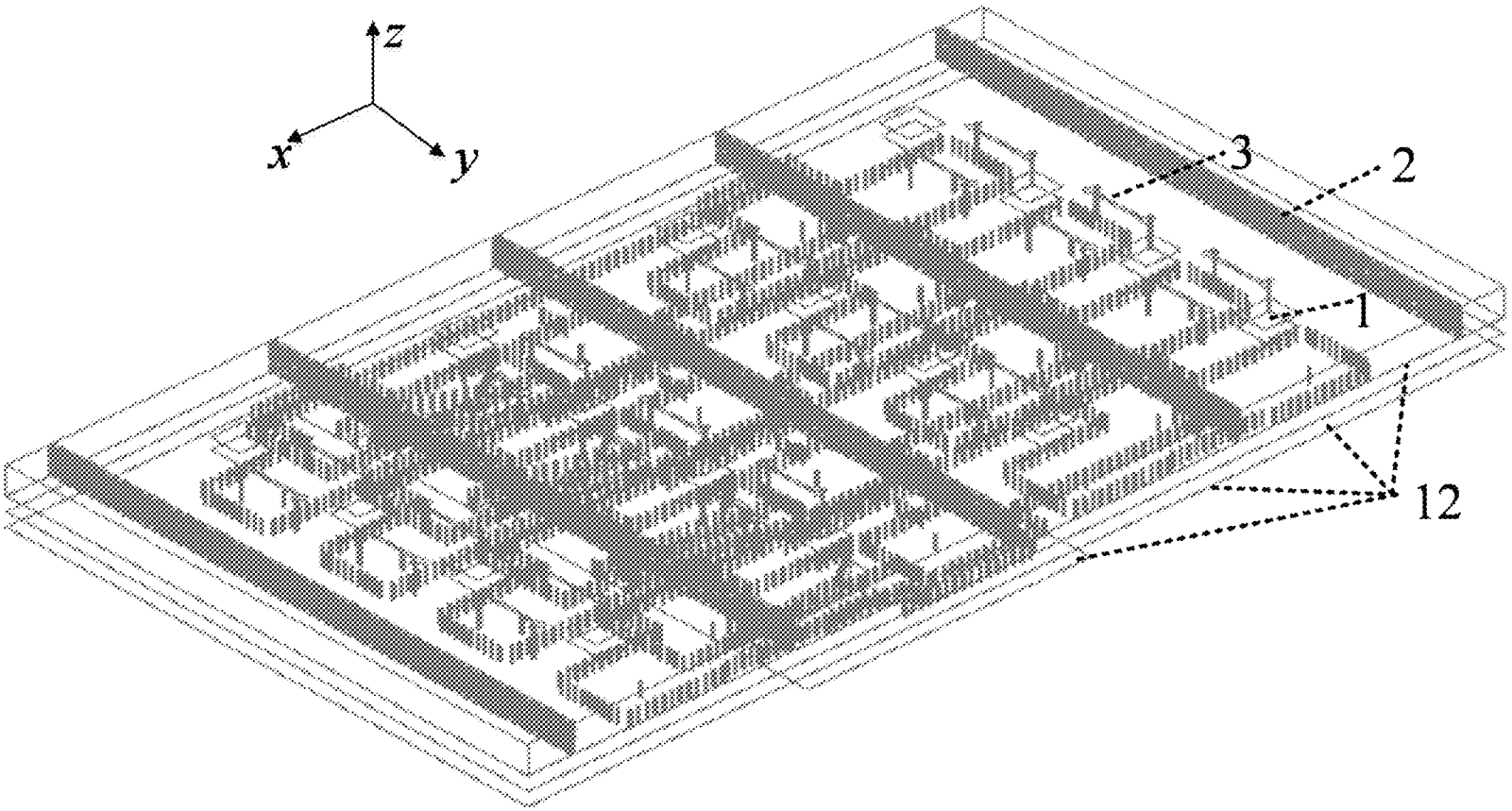
FIG. 11*a* is a schematic three-dimensional structural diagram of a high-isolation phased array antenna in Embodiment 3 of the present invention.
Figure 11B:
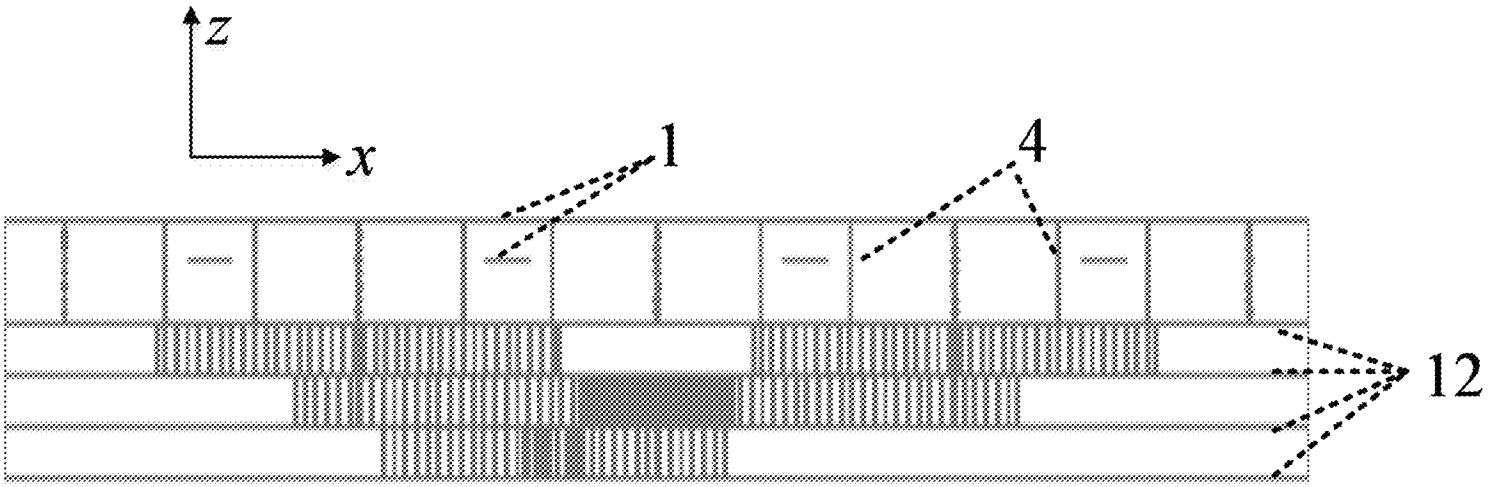
FIG. 11*b* is a schematic cross-sectional diagram of the high-isolation phased array antenna in Embodiment 3 of the present invention.
Figure 12A:
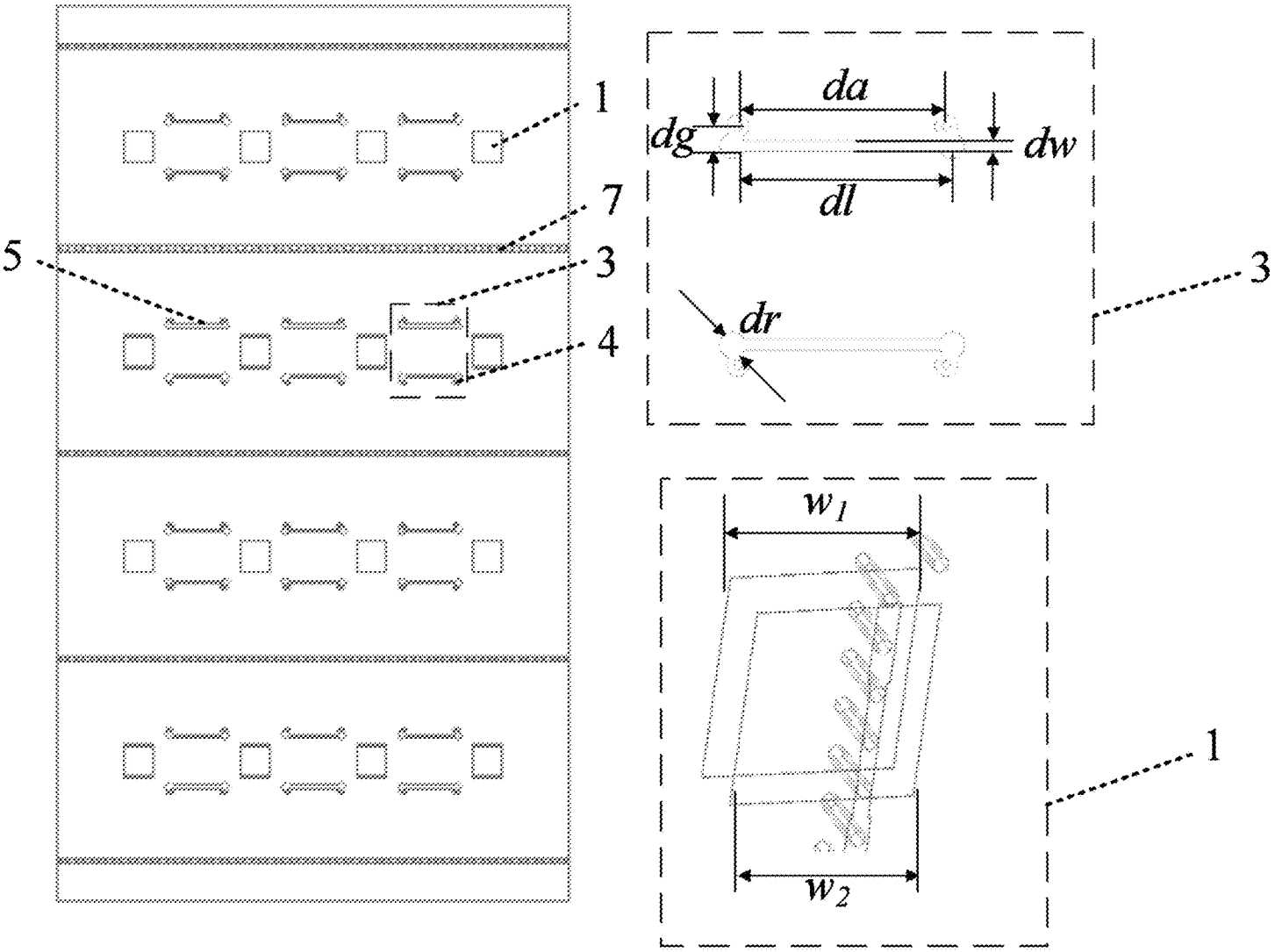
FIG. 12*a* is a top view of upper surfaces of a layer of a radiating stacked microstrip patch element (1) and a coupling-offset path in Embodiment 3 of the present invention.

In the present embodiment, as shown in FIG. 11*a* and FIG. 11*b*, a high-isolation millimeter-wave phased array antenna includes four identical subarrays, and an entire array is provided with four subarray ports: a first port 9, a second port 10, a third port 12, and a fourth port 13. As shown in FIG. 12*a*, the first port 9, the second port 10, the third port 12, and the fourth port 13 are placed below the subarrays, and are arranged in a row at a distance of 5 mm, thus being convenient for testing. Each subarray includes four radiating stacked microstrip patch elements 1 and three feeding network layers 11, and the feeding network layer 11 is a bisected substrate integrated waveguide power divider feeding network. The subarray includes the radiating stacked microstrip patch element 1 and a shielding metal wall 2 loaded with a second grounded vias 7. The radiating stacked microstrip patch element 1 is located on an uppermost lay, and the feeding network layer 11 is located on a lower layer. The feeding network layer 11 is coupled by a slot, has a parallel structure, and implements an equal-extent-and-phase exciting stacked microstrip patch. The I-shaped slot 6 is etched in the metal ground plane 12 to implement energy coupling between the feeding network layers 11. The coupling-offset path branch 3 loaded with the first grounded vias 4 is arranged between the radiating stacked microstrip patch elements 1. The coupling-offset path branch 3 for implementing the coupling-offset path includes a pair of first grounded vias 4 and a pair of π-shaped metal strips 5. The first port 9 is excited, energy of the feeding network layer 11 is coupled to the radiating stacked microstrip patch element 1 through the I-shaped slot 6, and the energy is transmitted to the second port 10 through an inherent coupling path portion. The coupling-offset path branch 3 is introduced to offset the inherent coupling path, thus achieving a high-isolation effect between the first port 9 and the second port 10. Similarly, the high-isolation effect may be achieved by adjacent second port 10 and third port 12, and adjacent third port 12 and fourth port 13.

In the present embodiment, the radiating stacked microstrip patch element 1 and the feeding network layer 11 are both processed by a low-temperature co-fired ceramic process, and a dielectric substrate is Ferro A6ME. An X-axis direction of the dielectric substrate is vertical, a Y-axis direction of the dielectric substrate is horizontal, and an original point is a center point of the dielectric substrate. A direction of an XY coordinate system mentioned in the present embodiment is subject to the accompanying drawings.

A dielectric constant εr of the dielectric substrate is [1, 10.2], a thickness of the dielectric substrate is [0.01λ, 0.3λ], and a thickness of a metal ground plane is [0.005λ, 0.1λ], wherein λ is a free space wavelength.

As shown in FIG. 11*a*, in the present embodiment, two layers of radiating patch structures are printed on an upper surface of the radiating stacked microstrip patch element 1, and the radiating patch structure is composed of a square metal patch, which is excited by the I-shaped slot 6. The binary antenna is arranged along an x-axis. The coupling-offset path branch 3 includes a pair of first grounded vias 4 and one cascaded π-shaped metal strip 5. An end of the π-shaped metal strip 5 is loaded with a circular metal patch. The phase and the amplitude of the introduced coupling-offset path are adjusted by adjusting heights, lengths, and widths of the first grounded vias 4 and the π-shaped metal strip 5, and a distance between the first grounded vias 4, such that the original inherent coupling path is offset, so as to decouple the subarray. A plurality of coupling-offset path branches 3 may be provided, and the introduced coupling-offset path branches 3 may have different shapes for further adjusting the amplitudes and the phases of the coupling-offset path branches, so as to achieve a better decoupling effect.

As shown in FIG. 11*b*, in the metal ground plane 12, a size and a shape of the I-shaped slot 6 are selected according to requirements, and a position of a third grounded vias 8 is adjusted to improve impedance matching.

In the present embodiment, a transmission line of the feeding network layer 11 is in a form of substrate integrated waveguide.

Figure 12B:
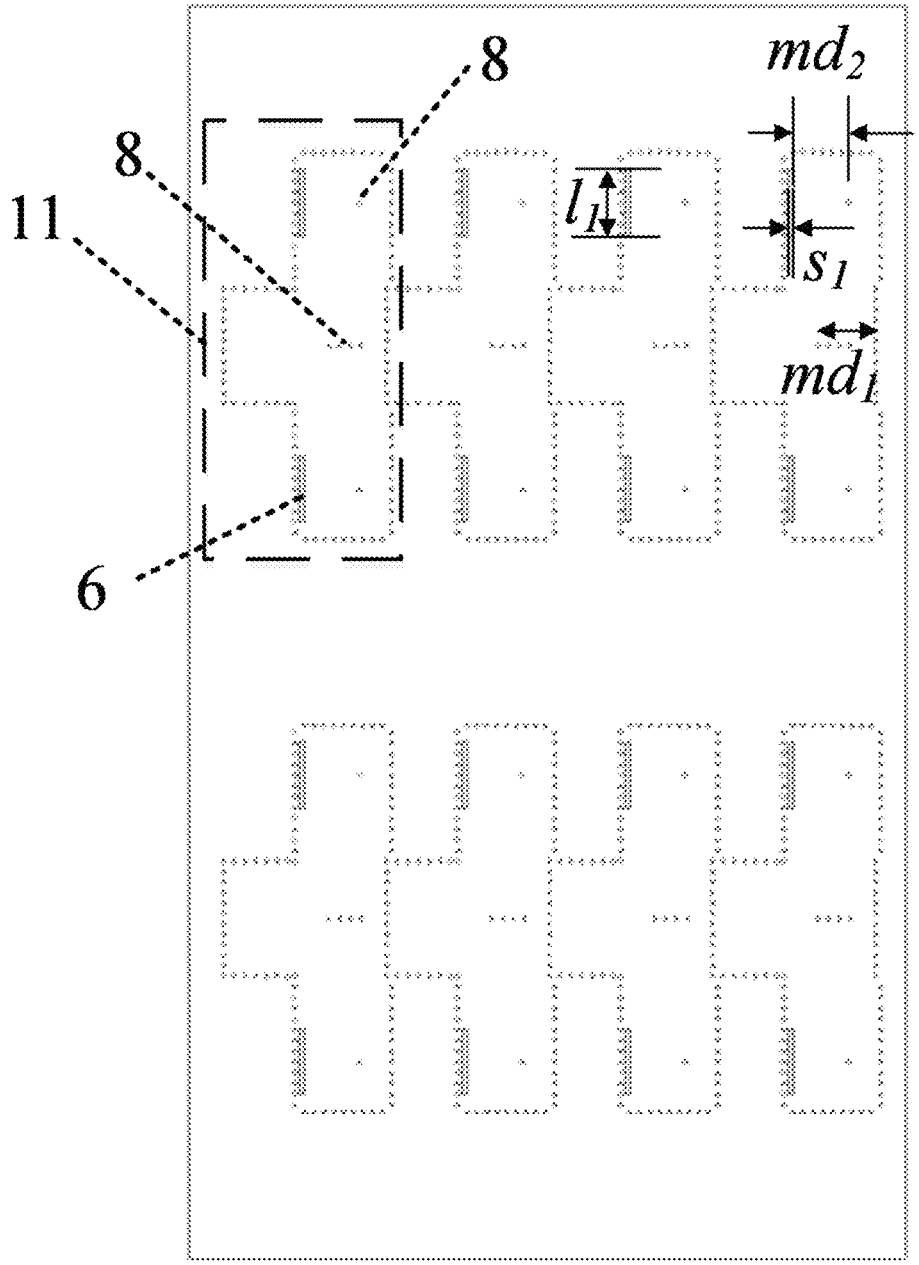
FIG. 12*b* is a bottom view of an upper surface of a feeding network in Embodiment 3 of the present invention.
Figure 12C:
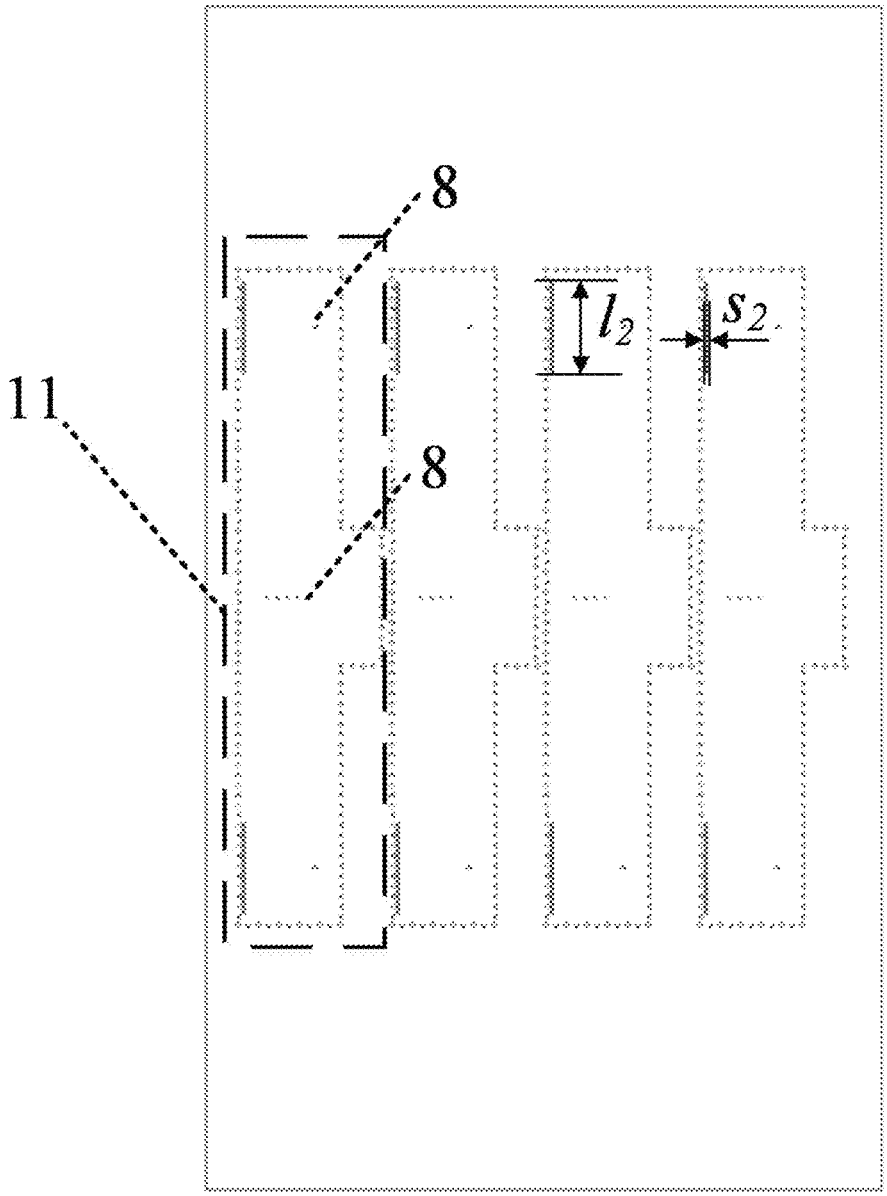
FIG. 12*c* is a bottom view of a middle surface of the feeding network in Embodiment 3 of the present invention.
Figure 12D:
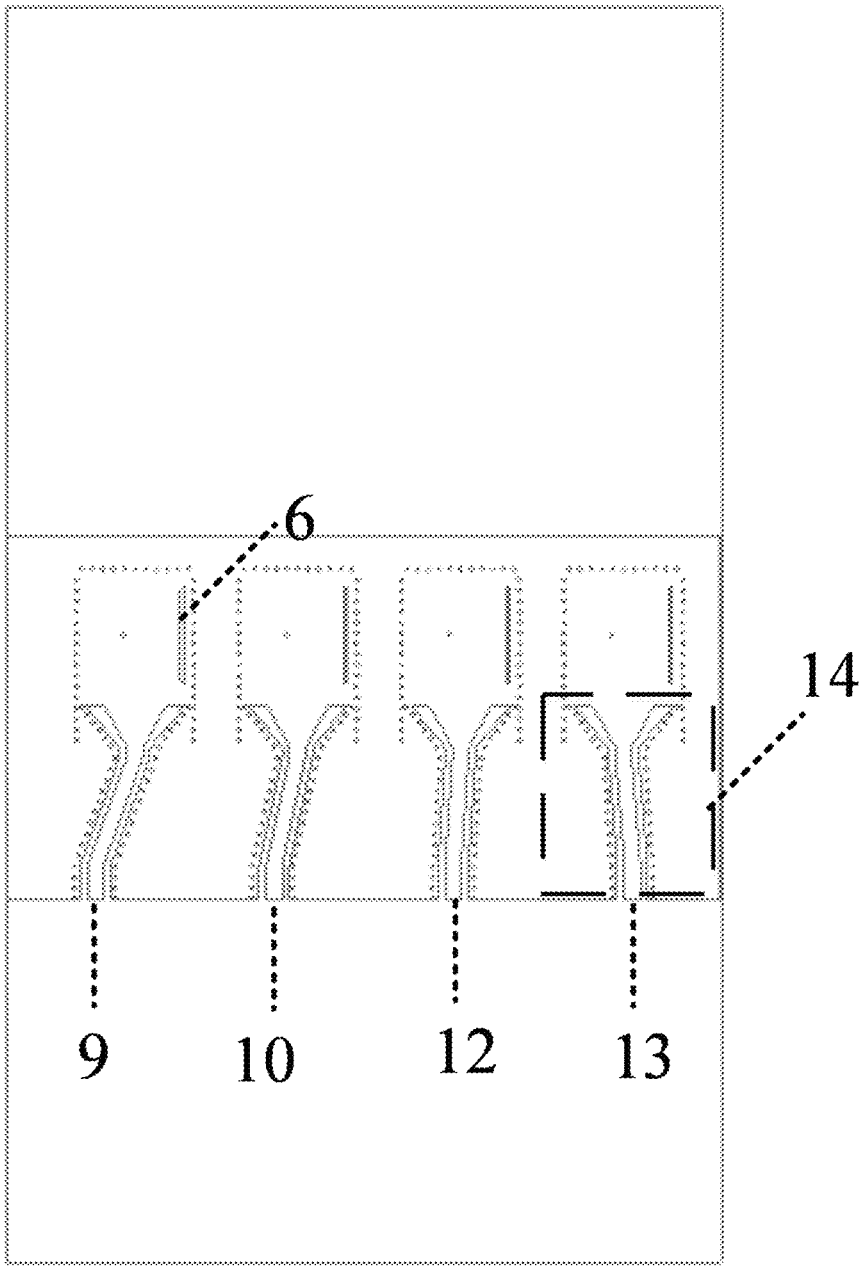
FIG. 12*d* is a bottom view of a lower surface of the feeding network in Embodiment 3 of the present invention.

As shown in FIG. 12*a*, a height of a patch of the radiating stacked microstrip patch element 1 is [0.01λ, 0.25λ], a size w1 of an upper patch of the radiating stacked microstrip patch element 1 is [0.1λ, 0.8λ], and a size w2 of a lower patch of the radiating stacked microstrip patch element is [0.2λ, 0.8λ]. A length l1 of the I-shaped slot 6 in the metal ground plane 12 is [0.1λ, 0.8λ], a length l2 of the I-shaped slot in the metal ground plane is [0.1λ, 0.8λ], a width s1 of the I-shaped slot 6 in the metal ground plane 12 is [0.001λ, 0.25λ], and a width s2 of the I-shaped slot in the metal ground plane is [0.001λ, 0.25λ]. A height of the coupling-offset path branch 3 is [0.01λ, 0.25λ], a distance dl between the pair of first grounded vias 4 of the coupling-offset path branch 3 is [0.01λ, 0.6λ], a length da of the metal strip 5 of the coupling-offset path branch 3 is [0.1λ, 0.6λ], a width dw of the metal strip 5 of the coupling-offset path branch 3 is [0.001λ, 0.1λ], a diameter dr of a disc at the end of the metal strip of the coupling-offset path branch 3 is [0.001λ, 0.1λ], and a distance dg between the first grounded vias 4 and the metal strip 5 of the coupling-offset path branch 3 is [0.001λ, 0.6λ]. As shown in FIG. 12*b*, FIG. 12*c*, and FIG. 12*d*, a distance s between metal grounded vias in the feeding network layer 11 is [0.001λ, 0.1λ], a diameter d of the metal grounded vias in the feeding network layer 11 is [0.001λ, 0.1λ], an edge distance md1 between the third grounded vias 8 and the feeding network layer 11 is [0.001λ, 0.1λ], and a distance md2 between the third grounded vias 8 and the I-shaped slot 6 of the feeding network layer 11 is [0.001λ, 0.1λ], wherein 2 is a free space wavelength.

In the present embodiment, a specific size of the high-isolation millimeter-wave phased-antenna array based on the coupling-offset path is as follows.

As shown in FIG. 12*a*, the height of the patch of the radiating stacked microstrip patch element 1 is 0.94 mm, the size w1 of the upper patch of the radiating stacked microstrip patch element 1 is 1.25 mm, and the size w2 of the lower patch of the radiating stacked microstrip patch element is 1.2 mm. The length l1 of the I-shaped slot 6 in the metal ground 12 is 1.85 mm, the length l2 of the I-shaped slot in the metal ground is 2.675 mm, the width s1 of the I-shaped slot 6 in the metal ground 12 is 0.135 mm, and the width s2 of the I-shaped slot in the metal ground is 0.1 mm. The height of the coupling-offset path branch 3 is 0.94 mm, the distance dl between the pair of first grounded vias 4 of the coupling-offset path branch 3 is 2.1 mm, the length da of the metal strip 5 of the coupling-offset path branch 3 is 2.3 mm, the diameter dr of the disc at the end of the metal strip 5 of the coupling-offset path branch 3 is 0.25 mm, the width dw of the metal strip 5 of the coupling-offset path branch 3 is 0.1 mm, and the distance dg between the first grounded vias 4 and the metal strip 5 of the coupling-offset path branch 3 is 0.2 mm. As shown in FIG. 12*b*, FIG. 12*c*, and FIG. 12*d*, the distance s between metal grounded vias in the feeding network layer 11 is 0.3 mm, the diameter d of the metal grounded vias in the feeding network layer 11 is 0.1 mm, the edge distance md1 between the third grounded vias 8 and the feeding network layer 11 is 0.9 mm, and the distance md2 between the third grounded vias 8 and the I-shaped slot 6 of the feeding network layer 11 is 1.9 mm.

Figure 13:
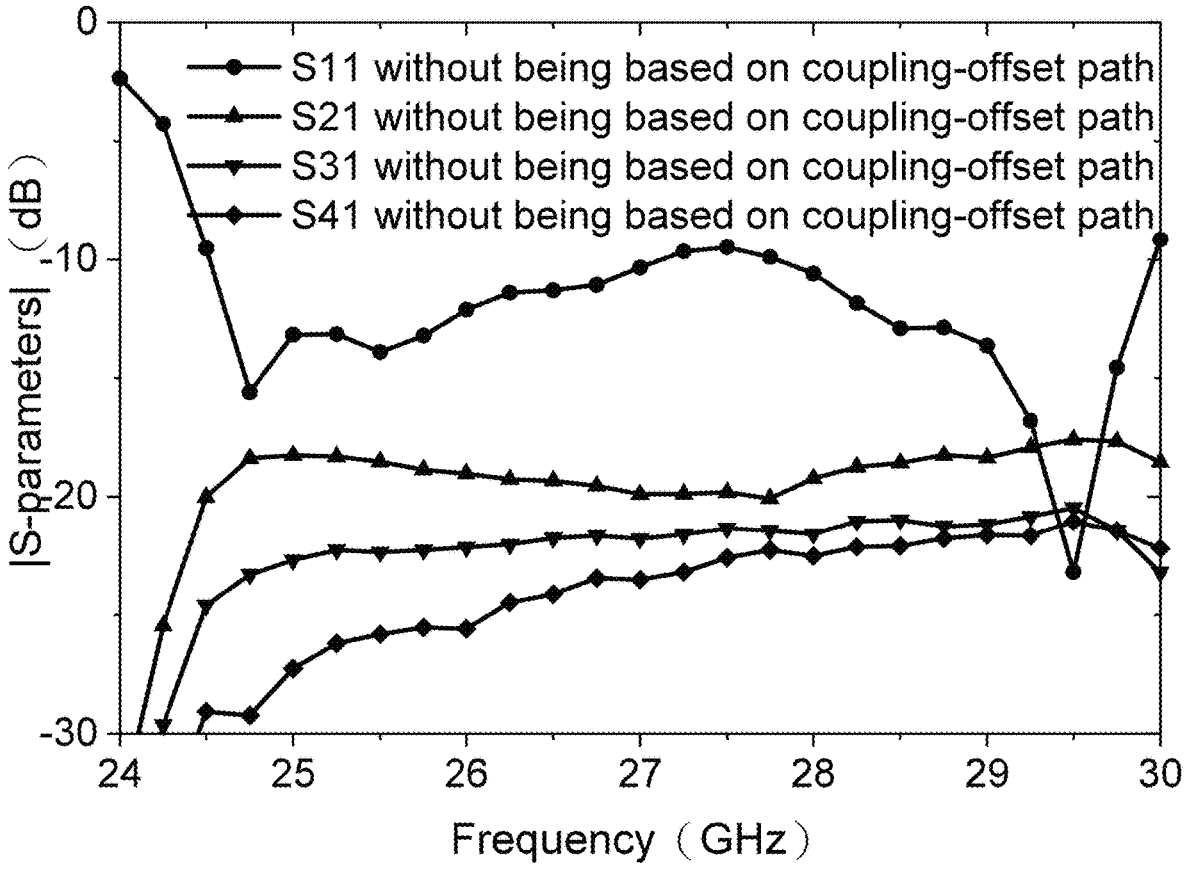
FIG. 13 is a result graph of S parameters of the phased array antenna in Embodiment 3 of the present invention before decoupling.
Figure 14:
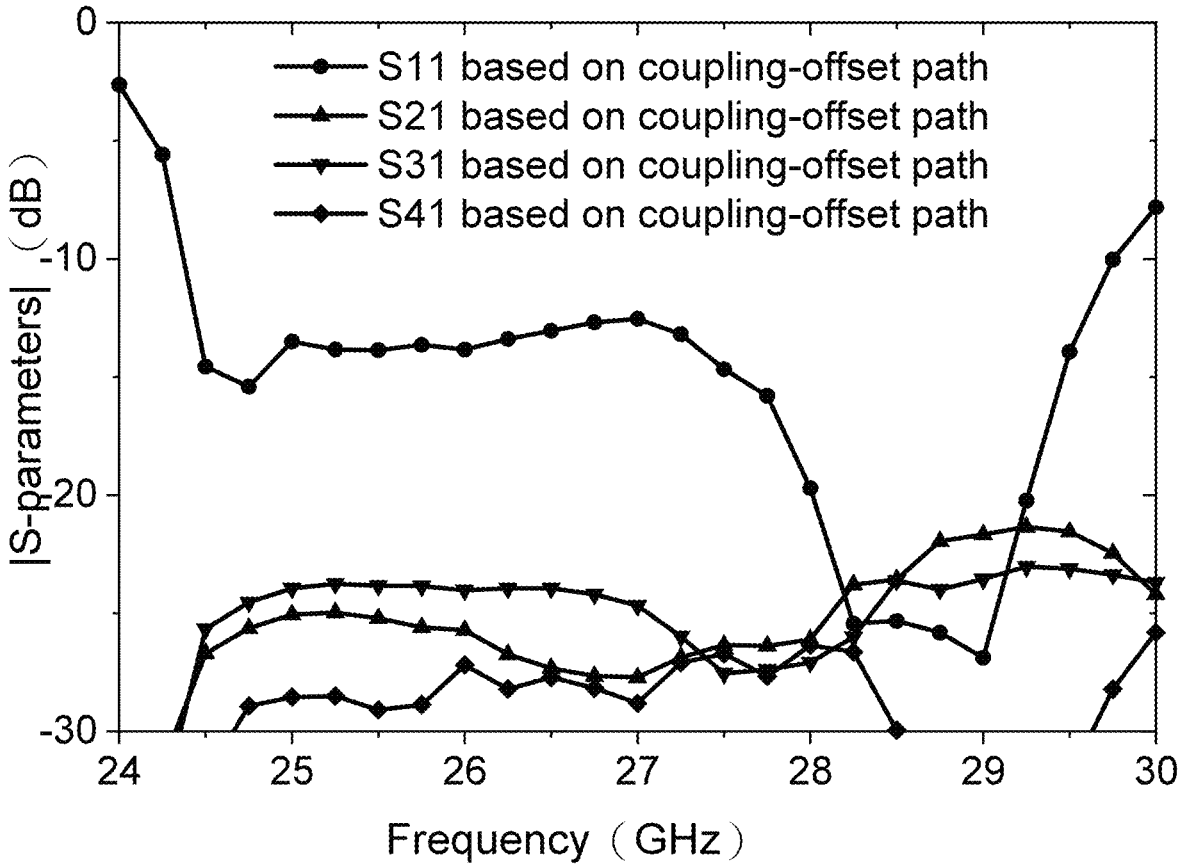
FIG. 14 is a result graph of S parameters of the binary array antenna in Embodiment 3 of the present invention after decoupling.

As shown in FIG. 13 and FIG. 14, for the high-isolation millimeter-wave phased antenna array based on the coupling-offset path, a working frequency band without decoupling is 24.5 GHz to 29.5 GHz, an in-band reflection coefficient is lower than −10 dB, and in-band polarization isolation is only 14 dB before decoupling. After decoupling based on the coupling-offset path, the working frequency band is 24.4 GHz to 29.5 GHz, the in-band reflection coefficient is lower than −10 dB, the in-band isolation is greater than 20 dB, and the isolation is improved by 6 dB maximumly.

Figure 15:
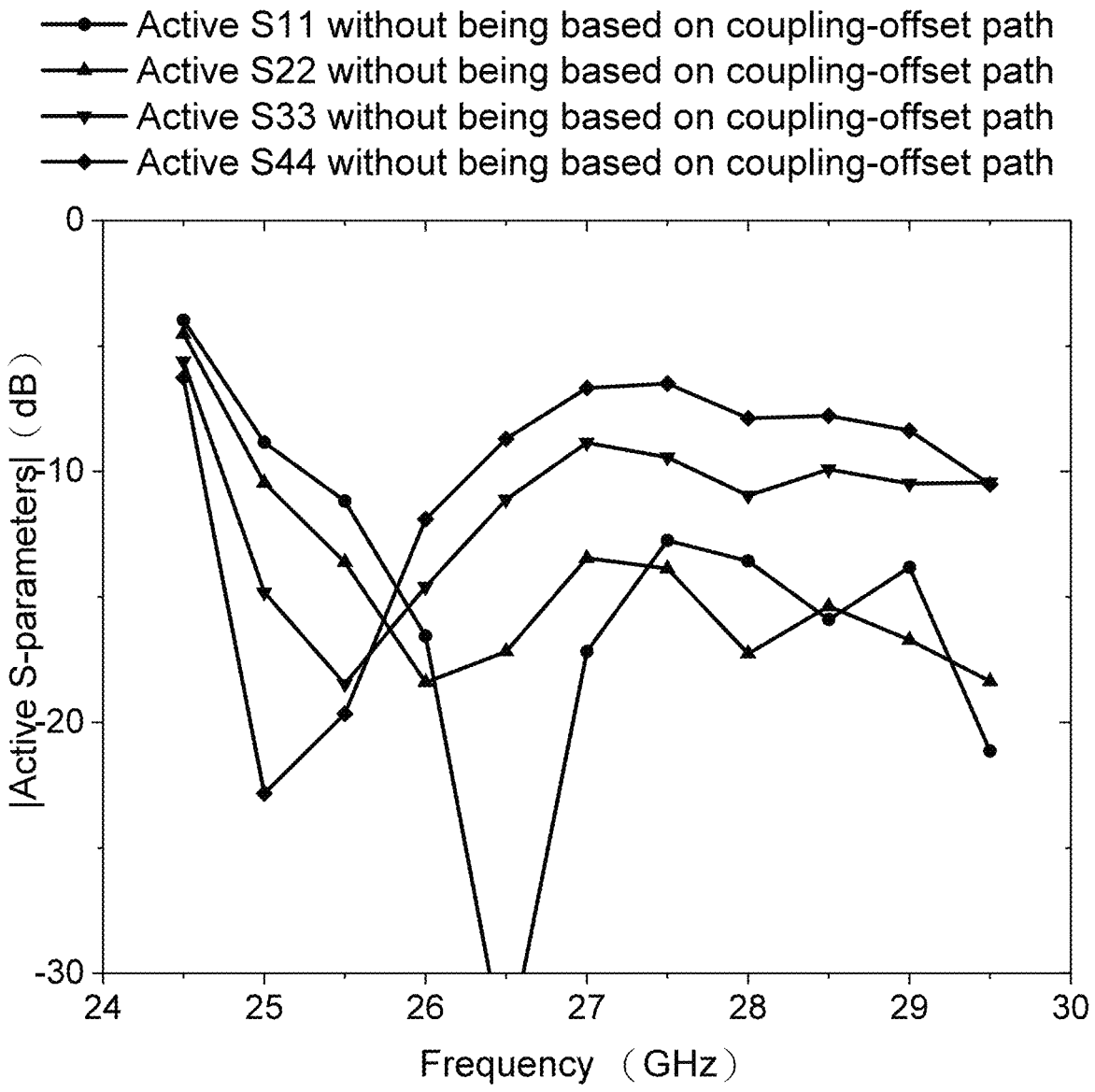
FIG. 15 is a result graph of scanning the active S parameters of the phased array antenna in Embodiment 3 of the present invention before decoupling to 50 deg.
Figure 16:
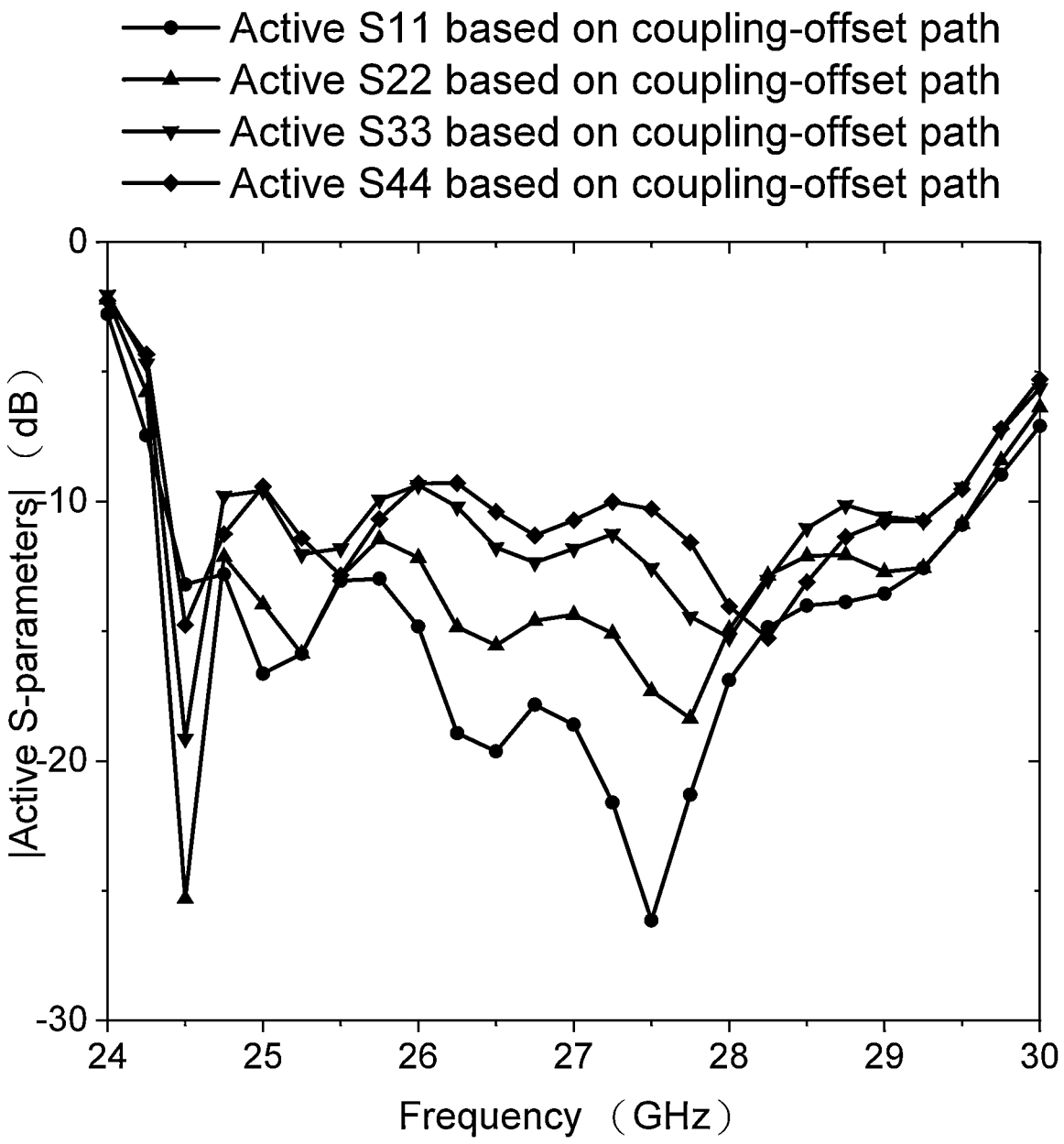
FIG. 16 is a result graph of scanning the active S parameters of the phased array antenna in Embodiment 3 of the present invention after decoupling to 50 deg.

As shown in FIG. 15 and FIG. 16, for the high-isolation millimeter-wave phased antenna array based on the coupling-offset path, an active reflection coefficient is lower than −10 dB in large-angle scanning, which is obviously improved as compared with an active reflection coefficient of the phased-antenna array without decoupling.

Figure 17:
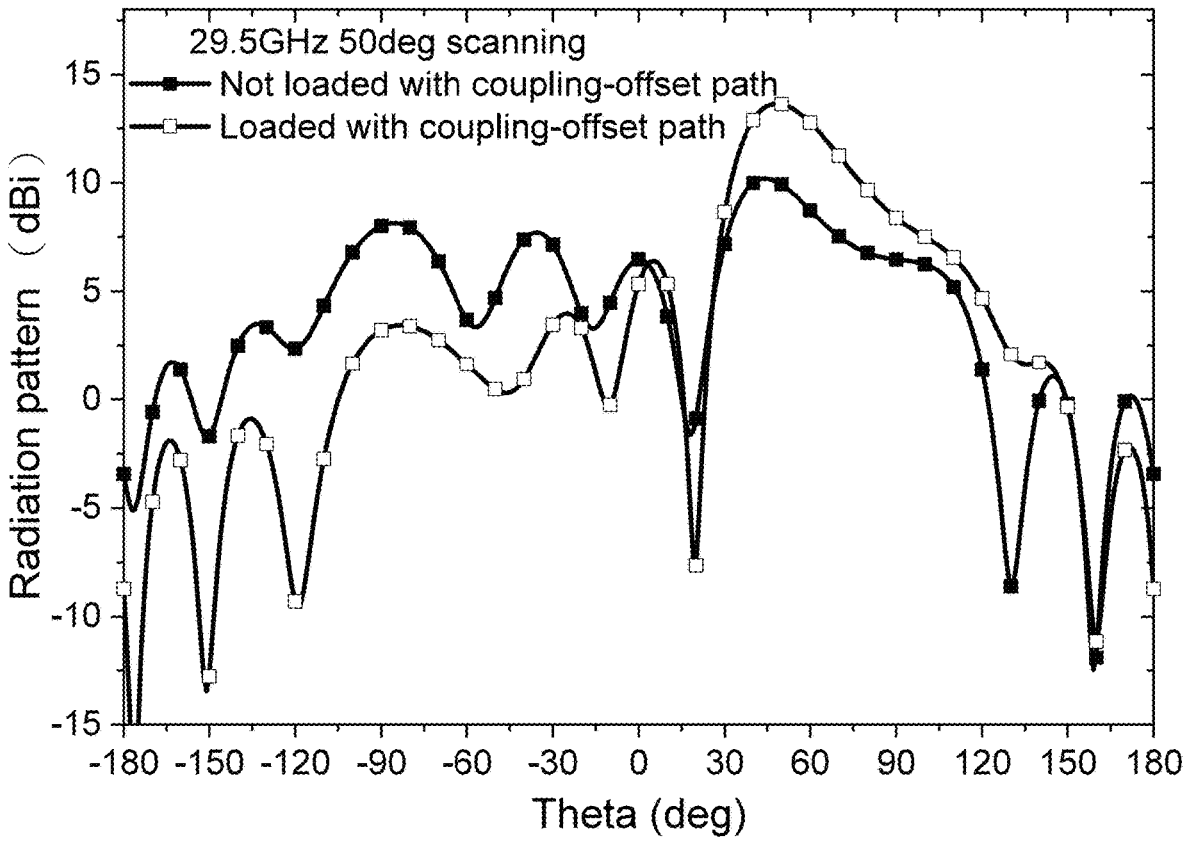
FIG. 17 is a direction diagram of the phased array antenna in Embodiment 3 of the present invention before and after decoupling at 29.5 GHz.

As shown in FIG. 17, performances of a main lobe level and a side lobe level of the high-isolation millimeter-wave phased-antenna array based on the coupling-offset path in large-angle scanning are obviously superior to those of the phased-antenna array without decoupling, which indicates that the high-isolation millimeter-wave phased-antenna array based on the coupling-offset path has an advantage of large-angle scanning.

Figure 18:
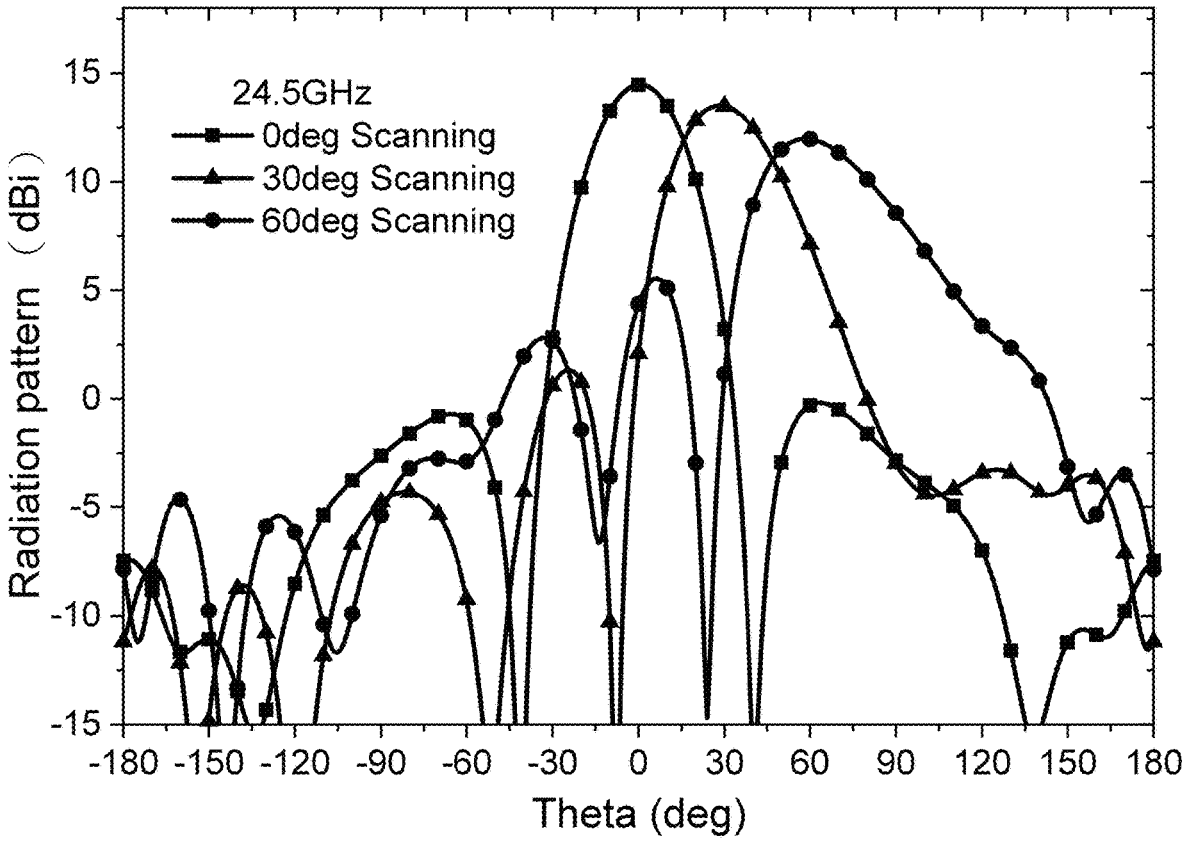
FIG. 18 is a scanning direction diagram of the phased array antenna in Embodiment 3 of the present invention after decoupling at 24.5 GHz.

As shown in FIG. 18, the high-isolation phased array antenna may scan to 60 deg at a low frequency of 24.5 GHz, without a grating lobe. If the high-isolation phased array antenna scans to 60 deg, the gain is decreased by about 2.4 dB.

Figure 19:
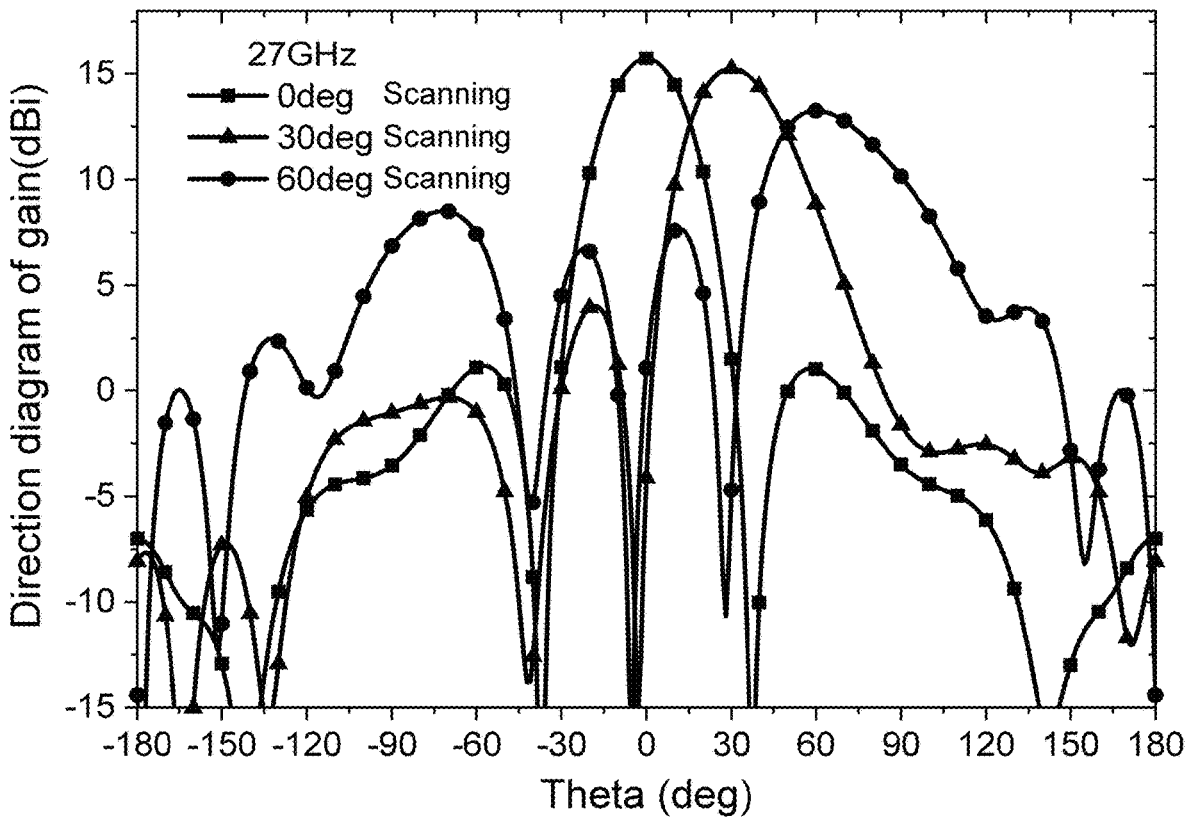
FIG. 19 is a scanning direction diagram of the phased array antenna in Embodiment 3 of the present invention after decoupling at 27 GHz.

As shown in FIG. 19, the high-isolation phased array antenna may scan to 60 deg at an intermediate frequency of 27 GHz, without an obvious grating lobe. If the high-isolation phased array antenna scans to 60 deg, the gain is decreased by about 2.5 dB.

Figure 20:
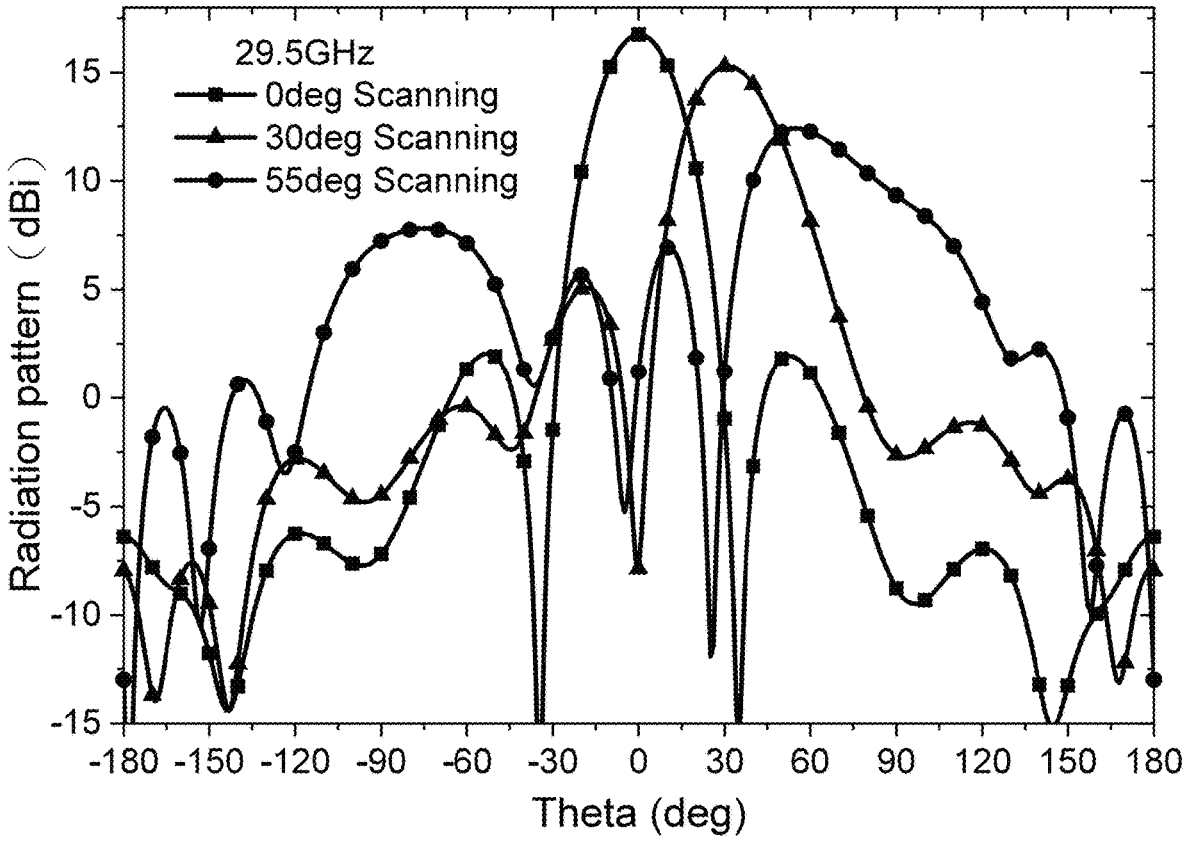
FIG. 20 is a scanning direction diagram of the phased array antenna in Embodiment 3 of the present invention after decoupling at 29.5 GHz.

As shown in FIG. 20, the high-isolation phased array antenna may scan to 55 deg at a high frequency of 29.5 GHz, without an obvious grating lobe.

It can be seen from the above that the high-isolation millimeter-wave phased array antenna based on the coupling-offset path effectively reduces isolation of adjacent subarrays, improves the active reflection coefficient of large-angle scanning, improves the radiation efficiency, and implements the characteristic of large-angle scanning.

The above embodiments are the preferred embodiments of the present invention, but the embodiments of the present invention are not limited by the above embodiments. Any other changes, modifications, substitutions, combinations, and simplifications made without departing from the spirit and principle of the present invention should be equivalent substitute modes, and should be included in the scope of protection of the present invention.

What is claimed is:

1. A high-isolation millimeter-wave phased array antenna, comprising a plurality of radiating stacked microstrip patch elements, a shielding metal wall, several coupling-offset path branches, a metal ground plane, a feeding network layer, a first port, and a second port;

wherein each of the coupling-offset path branches comprises two or more first grounded vias and at least one metal strip; when the at least one metal strip is one metal strip, the coupling-offset path branch is composed of the two first grounded vias and the metal strip, the two first grounded vias are symmetrically placed along a center of the metal strip; and when the at least one metal strip comprises a plurality of metal strips, the coupling-offset path branch is composed of the plurality of first grounded vias and the plurality of metal strips, every two of the first grounded vias are symmetrically placed along a center of one of the metal strips, and the plurality of metal strips are placed in parallel;

the radiating stacked microstrip patch elements are located on an uppermost layer, the coupling-offset path branches are located between the radiating stacked microstrip patch elements, the feeding network layer is located on a lowermost layer, the metal ground plane is arranged between the radiating stacked microstrip patch elements and the feeding network layer, and an I-shaped slot is etched in the metal ground plane; the first port and the second port are respectively located on a center line of a corresponding radiating stacked microstrip patch element of the radiating stacked microstrip patch elements; the first port is excited, energy of the feeding network layer is coupled to the corresponding radiating stacked microstrip patch element through the I-shaped slot, and the energy is transmitted to the second port adjacent to the first port through an inherent coupling path portion; and the coupling-offset path branches are introduced to offset the inherent coupling path, thus achieving a high-isolation effect between the first port and the second port.

2. The high-isolation millimeter-wave phased array antenna according to claim 1, wherein the coupling-offset path branches are symmetrically placed between the radiating stacked microstrip patch elements along an x axis; the at least one metal strip in the coupling-offset path branches is parallel or perpendicular to a polarization direction of the radiating stacked microstrip patch elements, and the first grounded vias in the coupling-offset path branches are symmetrically placed along the center of the metal strip; an amplitude and a phase of an introduced coupling-offset path are controlled by adjusting a height and a size of the coupling-offset path branches, so as to achieve conditions that the amplitude is consistent with that of the inherent coupling path and the phase is opposite to that of the inherent coupling path, so that the coupling-offset path and the inherent coupling path offset each other, thus achieving the high-isolation effect between the first port and the second port; and the plurality of radiating stacked microstrip patch elements are placed along the x axis, and a distance between the radiating stacked microstrip patch elements is calculated according to an array factor formula.

3. The high-isolation millimeter-wave phased array antenna according to claim 1, wherein the feeding network layer comprises a stripline feeding network, a microstrip line feeding network, a substrate integrated waveguide feeding network, or a coplanar waveguide feeding network.

4. The high-isolation millimeter-wave phased array antenna according to claim 1, wherein the I-shaped slot corresponds to the center of the corresponding radiating stacked microstrip patch element, and since the I-shaped slot is in linearly polarized excitation, the high-isolation millimeter-wave phased array antenna is in linearly polarized radiation.

5. The high-isolation millimeter-wave phased array antenna according to claim 4, wherein the shielding metal wall comprises a plurality of second grounded vias, and the plurality of second grounded vias are symmetrically placed around the I-shaped slot to form a cubic cavity for reducing field diffusion of the I-shaped slot; and a plurality of third grounded vias are placed on a bisector of the I-shaped slot to improve matching of the I-shaped slot.

6. The high-isolation millimeter-wave phased array antenna according to claim 1, wherein the coupling-offset path branch mainly solves coupling between two adjacent ports, so that the coupling-offset path branch is capable of being extended to a larger-scale high-isolation millimeter-wave phased array antenna according to a binary array arrangement scheme; and the coupling-offset path branch is placed between the radiating stacked microstrip patch elements which need decoupling.

7. The high-isolation millimeter-wave phased array antenna according to claim 1, wherein substrates adopted by the radiating stacked microstrip patch elements and the feeding network layer comprise a low-temperature co-fired ceramic substrate or a PCB dielectric substrate.

8. The high-isolation millimeter-wave phased array antenna according to claim 1, wherein each of the first grounded vias is a cuboid or a cylinder; and the at least one metal strip is capable of being π-shaped, n-shaped, H-shaped, L-shaped, or M-shaped.

9. The high-isolation millimeter-wave phased array antenna according to claim 1, wherein, the coupling-offset path branch is capable of being used in high-isolation array antennas comprising a microstrip patch antenna, a slot antenna, a metasurface antenna, an electric dipole antenna, an electromagnetic dipole antenna, a monopole antenna, a planar aperture antenna, or an on-chip antenna array.

* * * * *